US012390741B1

(12) United States Patent
Bilodeau et al.

(10) Patent No.: US 12,390,741 B1
(45) Date of Patent: Aug. 19, 2025

(54) RECONFIGURABLE TOY VEHICLE TRANSPORTER

(71) Applicant: Mattel, Inc., El Segundo, CA (US)

(72) Inventors: Maxence R. Bilodeau, Marina Del Rey, CA (US); Omar Rene González, Inglewood, CA (US); Gabriel De La Torre, Los Angeles, CA (US); Kar Fai So, Kwai Tsing (HK); Gang Zhang, Shen Zhen (CN)

(73) Assignee: MATTEL, INC., El Segundo, CA (US)

( * ) Notice: Subject to any disclaimer, the term of this patent is extended or adjusted under 35 U.S.C. 154(b) by 0 days.

(21) Appl. No.: 18/973,506

(22) Filed: Dec. 9, 2024

(51) Int. Cl.
*A63H 17/44* (2006.01)

(52) U.S. Cl.
CPC ..... *A63H 17/44* (2013.01)

(58) Field of Classification Search
CPC ..... A63H 17/44
USPC ... 446/71–76, 173, 174, 427, 428, 429, 431, 446/434, 435, 443, 448, 449, 4, 65
See application file for complete search history.

(56) References Cited

U.S. PATENT DOCUMENTS

| | | | | |
|---|---|---|---|---|
| 3,675,366 A | | 7/1972 | Tomiyama | |
| 4,192,093 A | | 3/1980 | Hamano | |
| 4,393,620 A | | 7/1983 | Murakami | |
| 4,477,999 A | | 10/1984 | Harigai et al. | |
| 4,504,239 A | | 3/1985 | Kulesza et al. | |
| 4,505,686 A | * | 3/1985 | Mariol | A63H 33/003 446/478 |
| 4,516,948 A | | 5/1985 | Obara | |
| 4,530,670 A | | 7/1985 | Ohno | |
| 4,568,307 A | | 2/1986 | Gabler et al. | |
| 4,708,683 A | * | 11/1987 | Lehmann | A63H 17/05 446/434 |
| 4,946,413 A | | 8/1990 | Lehmann et al. | |

(Continued)

FOREIGN PATENT DOCUMENTS

| | | |
|---|---|---|
| CN | 104107548 B | 9/2016 |
| CN | 112915556 A | 6/2021 |

(Continued)

OTHER PUBLICATIONS

Bilodeau et al., "Toy Vehicle Transporter", Pending Design U.S. Appl. No. 29/975,463, filed Nov. 27, 2024, 10 pages.

*Primary Examiner* — Nini F Legesse
(74) *Attorney, Agent, or Firm* — Edell, Shapiro & Finnan, LLC

(57) ABSTRACT

A reconfigurable toy vehicle transporter includes a first transporter that is reconfigurable between a first configuration and a second configuration, the first transporter including a base portion including a first surface having a first track, the base portion including a first compartment in which a toy vehicle can be stored, and a repositionable portion movably coupled to the base portion, the repositionable portion having a second compartment in which a toy vehicle can be stored, the repositionable portion including a second surface having a second track, the repositionable portion being placeable in a first position located above the first surface of the base portion and in a second position in an end-to-end arrangement with the base portion in which the first track and the second track are aligned and continuous. A second transporter is removably coupleable to the first transporter.

20 Claims, 33 Drawing Sheets

(56) References Cited

U.S. PATENT DOCUMENTS

| | | | | |
|---|---|---|---|---|
| 5,019,010 | A | 5/1991 | Nikaido et al. | |
| 5,580,296 | A | 12/1996 | Chow | |
| 5,924,910 | A | 7/1999 | Liu | |
| 6,000,988 | A | 12/1999 | Tsai | |
| 6,520,829 | B1 | 2/2003 | Temple | |
| 6,663,463 | B1 | 12/2003 | Dougherty et al. | |
| 6,699,096 | B2 | 3/2004 | Christopherson et al. | |
| 7,018,264 | B2 | 3/2006 | Foster et al. | |
| D582,492 | S | 12/2008 | Pasko et al. | |
| 7,942,721 | B2 | 5/2011 | Wade | |
| 7,950,977 | B2 | 5/2011 | Sun et al. | |
| 7,950,979 | B2 | 5/2011 | Barthold | |
| 8,075,364 | B2 | 12/2011 | Wai et al. | |
| 8,337,271 | B2 | 12/2012 | Campbell et al. | |
| 9,101,849 | B2 | 8/2015 | Bedolla et al. | |
| 9,700,809 | B1 * | 7/2017 | Harris | A63H 17/05 |
| 10,758,833 | B2 | 9/2020 | Hamel et al. | |
| 11,325,050 | B2 * | 5/2022 | Womack | A63H 17/05 |
| D963,054 | S | 9/2022 | Zhou | |
| 11,498,012 | B2 * | 11/2022 | Hwang | A63H 17/008 |
| D1,016,182 | S | 2/2024 | Cai | |
| 11,957,992 | B1 * | 4/2024 | Hwang | A63H 17/008 |
| D1,041,585 | S | 9/2024 | Yang | |
| D1,041,594 | S | 9/2024 | Zhou | |
| D1,046,016 | S | 10/2024 | Yang | |
| D1,050,290 | S | 11/2024 | Lin | |
| D1,057,857 | S | 1/2025 | Wang | |
| D1,058,700 | S | 1/2025 | Lin | |
| 2003/0224694 | A1 | 12/2003 | Hoeting et al. | |
| 2006/0079150 | A1 | 4/2006 | Filoseta et al. | |
| 2007/0054587 | A1 | 3/2007 | Myers | |
| 2008/0070475 | A1 | 3/2008 | Hippely | |
| 2014/0051325 | A1 | 2/2014 | Paukert et al. | |
| 2025/0050234 | A1 | 2/2025 | Li | |

FOREIGN PATENT DOCUMENTS

| | | | |
|---|---|---|---|
| CN | 110270110 | B | 6/2024 |
| CN | 110302546 | B | 6/2024 |
| CN | 118142181 | A | 6/2024 |
| CN | 110270113 | B | 8/2024 |
| WO | 2008133700 | A1 | 11/2008 |
| WO | 2020187087 | A1 | 9/2020 |

* cited by examiner

RECONFIGURABLE TOY VEHICLE TRANSPORTER

TECHNICAL FIELD

The present application relates generally to a reconfigurable toy vehicle transporter and, in particular, to a toy vehicle transporter that has multiple transporter portions that can be repositioned relative to each other, and also coupled and decoupled from each other to provide different modes of play.

BACKGROUND

Toys provide entertainment for different users, such as children. For example, a toy may include various features with which a child may play. An example toy that may entertain a child is a toy vehicle. Some conventional toys are transporters that can be used by a child to collect and carry toy vehicles. In some conventional toy vehicle transporters, the variability of play is limited. Conventional toy vehicle transporters have a single mode of play.

Thus, there is a need for a toy vehicle transporter that is easily reconfigurable and that provides multiple modes of operation facilitating different play.

SUMMARY

A reconfigurable toy vehicle transporter according to one embodiment of the present disclosure includes a first transporter that is reconfigurable between a first configuration and a second configuration, the first transporter including a base portion including a first surface having a first track, the base portion including a first compartment in which a toy vehicle can be stored; and a repositionable portion movably coupled to the base portion, the repositionable portion having a second compartment in which a toy vehicle can be stored, the repositionable portion including a second surface having a second track, the repositionable portion being placeable in a first position located above the first surface of the base portion and in a second position in an end-to-end arrangement with the base portion in which the first track and the second track are aligned and continuous; and a second transporter that is removably coupleable to the first transporter, wherein the second transporter has a third compartment in which a toy vehicle can be stored.

In one embodiment, the first transporter includes a first arm and a second arm, each of the first arm and the second arm is pivotally coupled to the base portion and also pivotally coupled to the repositionable portion, and the repositionable portion is moved relative to the base portion via movement of the first arm and the second arm.

In another embodiment, the first arm is coupled to the base portion at a first location and coupled to the repositionable portion at a second location, the second arm is coupled to the base portion at a third location and coupled to the repositionable portion at a fourth location, the first location being forward of the third location, and the second location being forward of the fourth location.

In yet another embodiment, the base portion has a first slot and the repositionable portion has a second slot, and the first arm and the second arm are located in the first slot and the second slot when the repositionable portion is in its first position above the base portion.

In an alternative embodiment, the base portion has an outlet opening that is in communication with the first track, the repositionable portion has a launcher proximate to the second track, and when the repositionable portion is in its second position, the launcher can be actuated to launch a toy vehicle along the second track, then along the first track, and then through the outlet opening.

In one embodiment, the second transporter includes a body having an inlet through which toy vehicles can be collected from a support surface.

In another embodiment, the second transporter includes a body having a first side and a second side opposite the first side, the body includes a first wing pivotally mounted to the first side, a second wing pivotally mounted to the second side, and an input member that can be actuated to cause the first wing and the second wing to pivot relative to the body of the second transporter.

In addition, the body includes an internal receptacle, the first wing includes a first track portion that is oriented toward the internal receptacle, and a toy vehicle can be placed on the first track portion of the first wing and can travel from the first wing to the internal receptacle.

In one embodiment, the repositionable portion includes a holding member pivotally connected to the repositionable portion, and the holding member engages the second transporter when the second transporter is placed on the first transporter.

In another embodiment, the first transporter has a locking member, and the second transporter has a release mechanism that can be actuated to decouple the second transporter from the first transporter.

A reconfigurable toy vehicle transporter according to another embodiment of the present disclosure includes a first transporter that is reconfigurable between a first configuration and a second configuration, the first transporter including a base including a first compartment in which a toy vehicle can be stored; and a repositionable portion movably coupled to the base, the repositionable portion having a second compartment in which a toy vehicle can be stored, the repositionable portion being placeable in a first position above the base and in a second position in an end-to-end arrangement with the base; and a second transporter that is removably coupleable to the first transporter, wherein the second transporter has a third compartment in which a toy vehicle can be stored and the second transporter has a toy vehicle intake mechanism that can collect toy vehicles from a support surface.

In an alternative embodiment, the first transporter includes an arm that is pivotally coupled to the base and pivotally coupled to the repositionable portion, and the repositionable portion is moved relative to the base via the arm.

In another embodiment, the base has a first track, the repositionable portion has a second track, and the second track is aligned with the first track when the repositionable portion is in its second position.

In yet another embodiment, the base has an outlet opening that is in communication with the first track, the repositionable portion has a launcher proximate to the second track, and when the repositionable portion is in its second position, the launcher can be actuated to launch a toy vehicle along the second track, then along the first track, and then through the outlet opening.

In an alternative embodiment, the second transporter includes a body having a wing pivotally mounted thereto, an actuator that can be engaged by a user to move the wing relative to the body of the second transporter, and an internal receptacle that receives a toy vehicle that travels along the wing into the internal receptacle.

A reconfigurable toy vehicle transporter according to another embodiment of the present disclosure includes a first transporter including a base having an upper surface with a track formed therein, the base including a first compartment in which a toy vehicle can be stored; and a repositionable portion movably coupled to the base, the repositionable portion having a second compartment in which a toy vehicle can be stored, the repositionable portion having its own upper surface with a track formed therein, the repositionable portion being placeable in a first position above the base and in a second position end-to-end with the base in which the tracks are aligned and continuous, the repositionable portion including a launcher that can be actuated to propel a toy vehicle along the track on the repositionable portion and then along the track on the base; and a second transporter that is removably coupleable to the first transporter, wherein the second transporter has a third compartment in which a toy vehicle can be stored.

In another embodiment, the second transporter includes a body having an inlet through which toy vehicles can be collected from a support surface, and the body has a first internal receptacle in which collected toy vehicles are disposed.

In an alternative embodiment, the body has a wing pivotally mounted to the body, and an actuator that can be engaged to cause the wing to pivot relative to the body, the wing including a track portion that is directed toward a second internal receptacle so that a toy vehicle placed on the track portion travels from the wing to the second internal receptacle.

In yet another embodiment, the repositionable portion includes a holding member pivotally connected to the repositionable portion, and the holding member engages the second transporter when the second transporter is placed on the first transporter.

In one embodiment, the first transporter has a locking member, the second transporter includes a release mechanism that can be actuated to decouple the second transporter from the first transporter.

BRIEF DESCRIPTION OF THE DRAWINGS

The toy vehicle transporter presented herein may be better understood with reference to the following drawings and description. Unless dimensions of elements of the drawings are specifically called-out and described herein, it should be understood that the elements in the figures are not necessarily to scale and that emphasis has been placed upon illustrating the principles of the toy vehicle. In the drawings, like-referenced numerals designate corresponding parts throughout the different views.

DETAILED DESCRIPTION

In a toy vehicle transporter according to the aspects disclosed herein has a base transporter and a repositionable transporter that can be moved relative to the base transporter and placed into different positions. In one position, the repositionable transporter and the base transporter can be in a stacked configuration. In another position, the repositionable portion and the base portion can be in an end-to-end arrangement. A removable transporter can be coupled to and decoupled from the toy vehicle transporter. Each transporter and portion includes at least one cavity or receptacle in which a toy vehicle can be placed.

Figure 1:
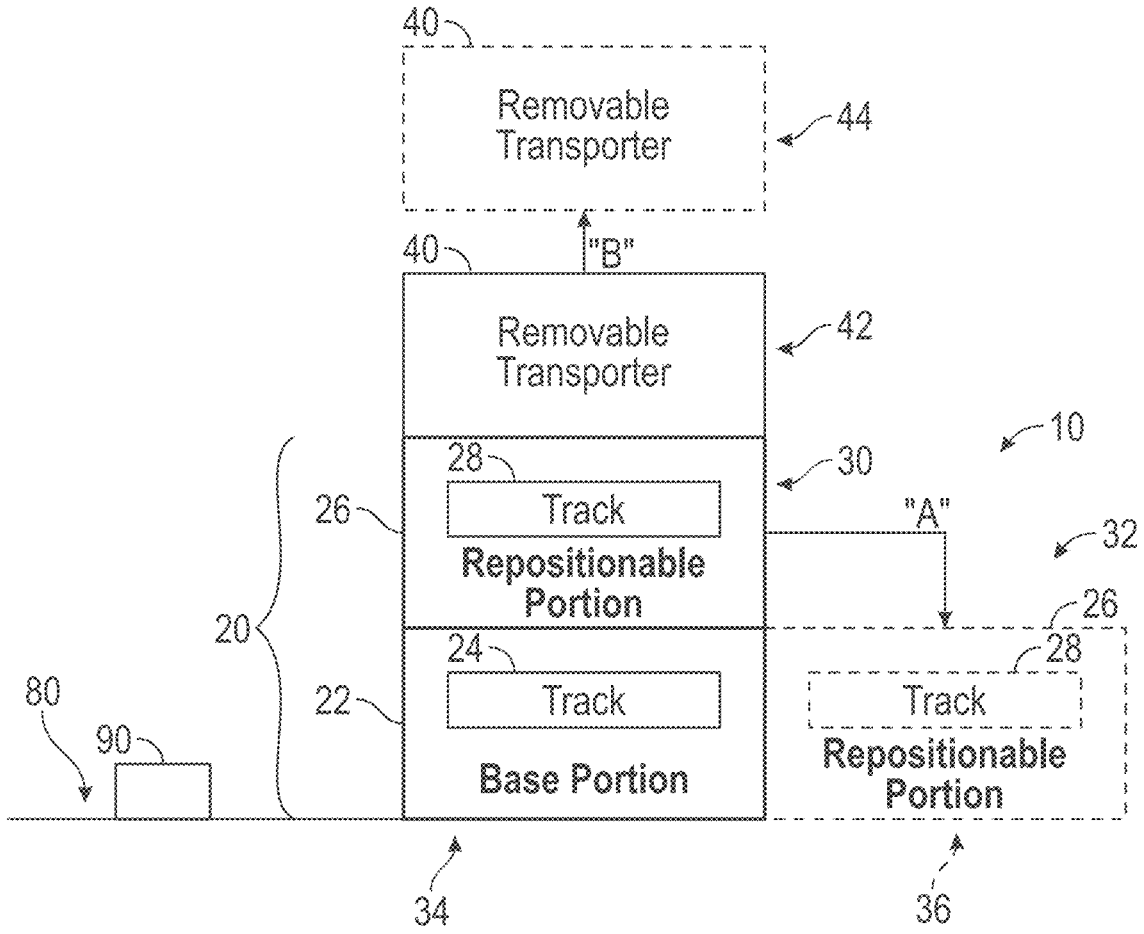
FIG. 1 illustrates a schematic block diagram of an embodiment of a toy vehicle transporter according to the present disclosure.

Initially referring to FIG. 1, a schematic block diagram of an embodiment of a toy vehicle transporter according to the present disclosure is illustrated. Several components of the toy vehicle transporter are shown in FIG. 1 in generic form. It is to be understood that the various details and features of the components of the toy vehicle transporter may vary in different embodiments.

Toy vehicle transporter 10 can be referred to as a reconfigurable toy vehicle transporter because one or more of the components of the toy vehicle transporter 10 can be repositioned to change the overall configuration of the toy vehicle transporter 10. As a result, a child can have different play patterns and experiences with the different configurations.

In this embodiment, toy vehicle transporter 10 includes a transporter 20 and a removable transporter 40. The transporter 20 includes at least one cavity or recess in which a toy vehicle can be placed. Similarly, the removable transporter 40 includes at least one cavity or recess in which a toy vehicle can be placed.

The transporter 20 includes a base portion 22 and a repositionable portion 26 that is movably coupled to the base portion 22. The coupling between the base portion 22 and the repositionable portion 26 enables the repositionable portion 26 to be placed in multiple positions relative to the base portion 22. In particular, the repositionable portion 26 can be placed into a position 30 in which the repositionable portion 26 is located above or on top of the base portion 22. When portion 26 is in position 30, the transporter 20 has a first configuration 34. In configuration 34, the base portion 22 and the repositionable portion 26 have a stacked arrangement.

The repositionable portion 26 can be moved along the direction of arrow "A" to a different position. In particular, the repositionable portion 26 can be moved to position 32 (shown in dashed lines) in which an end of the repositionable portion 26 is placed adjacent to an end of the base portion 22. When the portions 22 and 26 are in these positions, the toy vehicle transporter 20 has a second configuration 36 in which portions 22 and 26 are in an end-to-end arrangement. A user can move the repositionable portion 26 from position 32 to position 30 in a direction opposite to that of arrow "A" in FIG. 1. In one embodiment, movement of the repositionable portion 26 relative to base portion 22 is performed manually.

In addition, the base portion 22 has one or more tracks 24 formed therein, which in one embodiment, may extend along a length of the base portion 22. Similarly, repositionable portion 26 has one or more tracks 28 formed therein, which in one embodiment, may extend along a length of the repositionable portion 26. Each of the tracks 24 and 28 is sized and configured to receive a toy vehicle and allow the toy vehicle to travel along the tracks 24 and 28. When repositionable portion 26 is in its position 32, track 24 is aligned with track 28, thereby permitting a toy vehicle to travel continuously from one of the tracks 24 and 28 to the other of tracks 24 and 28.

The removable transporter 40 of reconfigurable toy vehicle transporter 10 can be coupled to and decoupled from transporter 20. The removable transporter 40 includes at least one cavity or receptacle in which a toy vehicle can be placed. The removable transporter 40 can be placed in a position 42 in which the removable transporter 40 is placed on transporter 20 and coupled thereto. When the removable transporter 40 is decoupled from the transporter 20, the removable transporter 40 can be moved away from the transporter 20 along the direction of arrow "B" to another position 44.

The transporter 20 can be placed on a support surface 80 on which one or more toy vehicles 90 can be located. In one embodiment, one of the transporter 20 and the removable transporter 40 has a mechanism that can either engage a toy vehicle 90 on support surface 80 or gather one or more toy vehicles 90 from the support surface 80.

Figure 2:
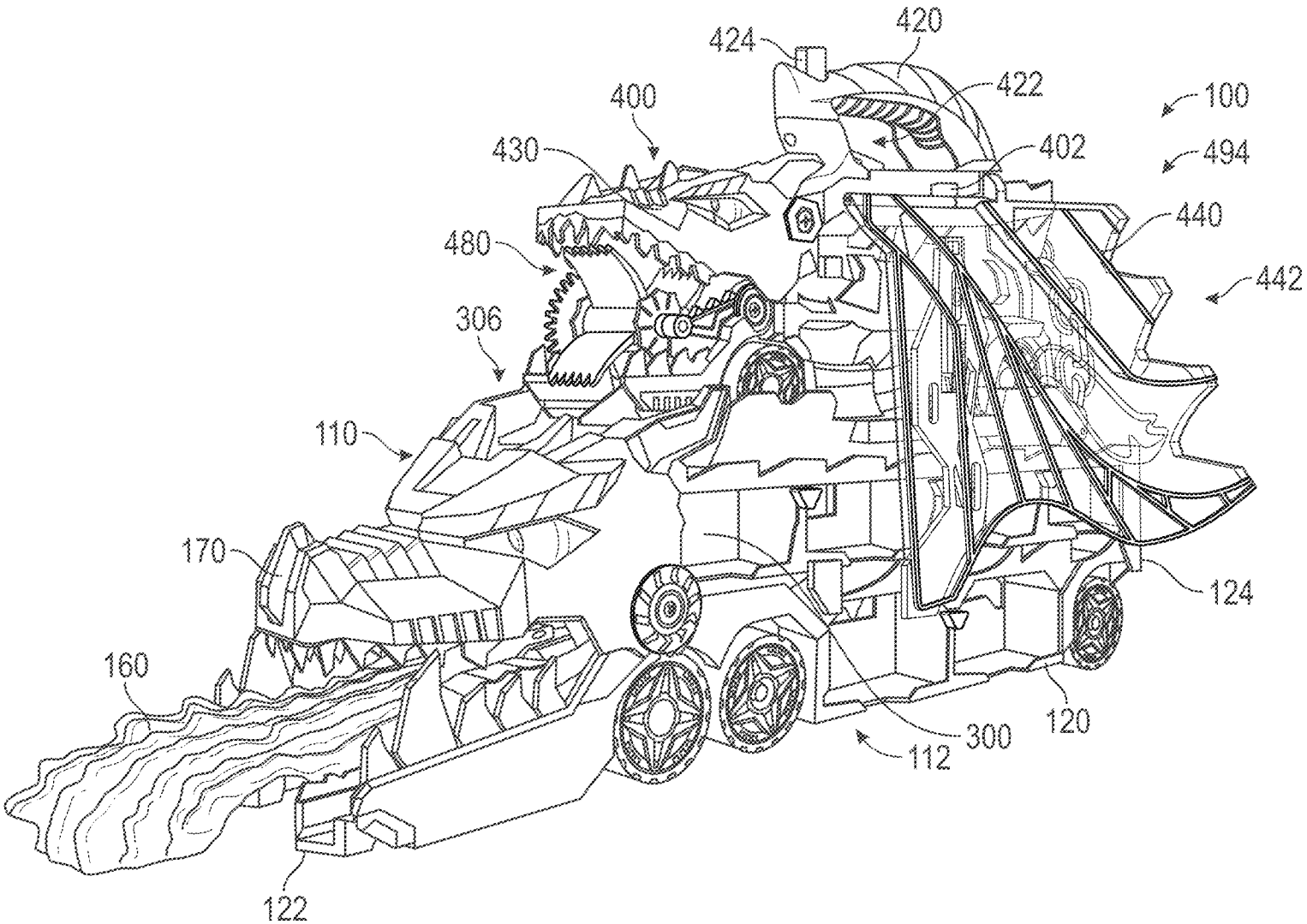
FIG. 2 illustrates a perspective view of an embodiment of a toy vehicle transporter according to the present disclosure.

Turning to FIG. 2, an embodiment of a toy vehicle transporter that is reconfigurable according to the present disclosure is illustrated. Toy vehicle transporter 100 includes a transporter 110 and a removable transporter 400 that can be coupled to and decoupled from the transporter 110. Removable transporter 400 is illustrated in FIG. 2 as being mounted on the transporter 110.

Transporter 110 is shown in a folded or collapsed configuration 112. Transporter 110 includes a base portion 120 that has several different features as described herein. Base portion 120 extends from a first or front end 122 to a second or rear end 124. In this embodiment, transporter 110 includes a tongue 160 that is driven side-to-side by a gear arrangement that is driven by rotation of an axle coupled to wheels of the transporter 110. The tongue 160 extends forwardly from the front end 122. Also located at the front end 122 is a pivotally mounted head member 170, which in this embodiment resembles a head of a toy animal.

The transporter 110 also includes a repositionable portion 300 that is movably coupled to the base portion 120. In FIG. 2, the repositionable portion 300 is shown in a first position 306 in which the repositionable portion 300 is located above the base portion 120.

Turning to the removable transporter 400, the removable transporter 400 is shown in FIG. 2 in its coupled position 494 relative to repositionable portion 300. The removable transporter 400 has a body 402 that has a handle 420 defining an opening 422 through which a child's hand may be inserted. Located proximate to handle 420 is an actuator 424 that can be pressed by a child to release wing portions coupled to body 402 from their lowered or retracted positions proximate to the body 402 so the wing portions can move to their deployed positions in which they extend outwardly from the body 402. Each of the wing portions is biased by a biasing mechanism to its deployed or raised position, and can be moved manually by a child from its deployed or raised position back to its retracted position. In FIG. 2, only wing 440 is illustrated, which is shown in its lowered position 442 in which wing 440 is retained by a latch against the biasing force of a biasing mechanism, such as a spring.

In this embodiment, removable transporter 400 includes a head 430 that is pivotally mounted to the body 402, and a toy vehicle collector 480 that engages toy vehicles on a support surface and moves the toy vehicles into a receptacle in the body 402. As described in more detail below, the toy vehicle collector 480 includes a rotating hub that is driven by rotation of an axle coupled to the body 402, and the hub includes several paddles extending therefrom that engage toy vehicles.

Figure 3:
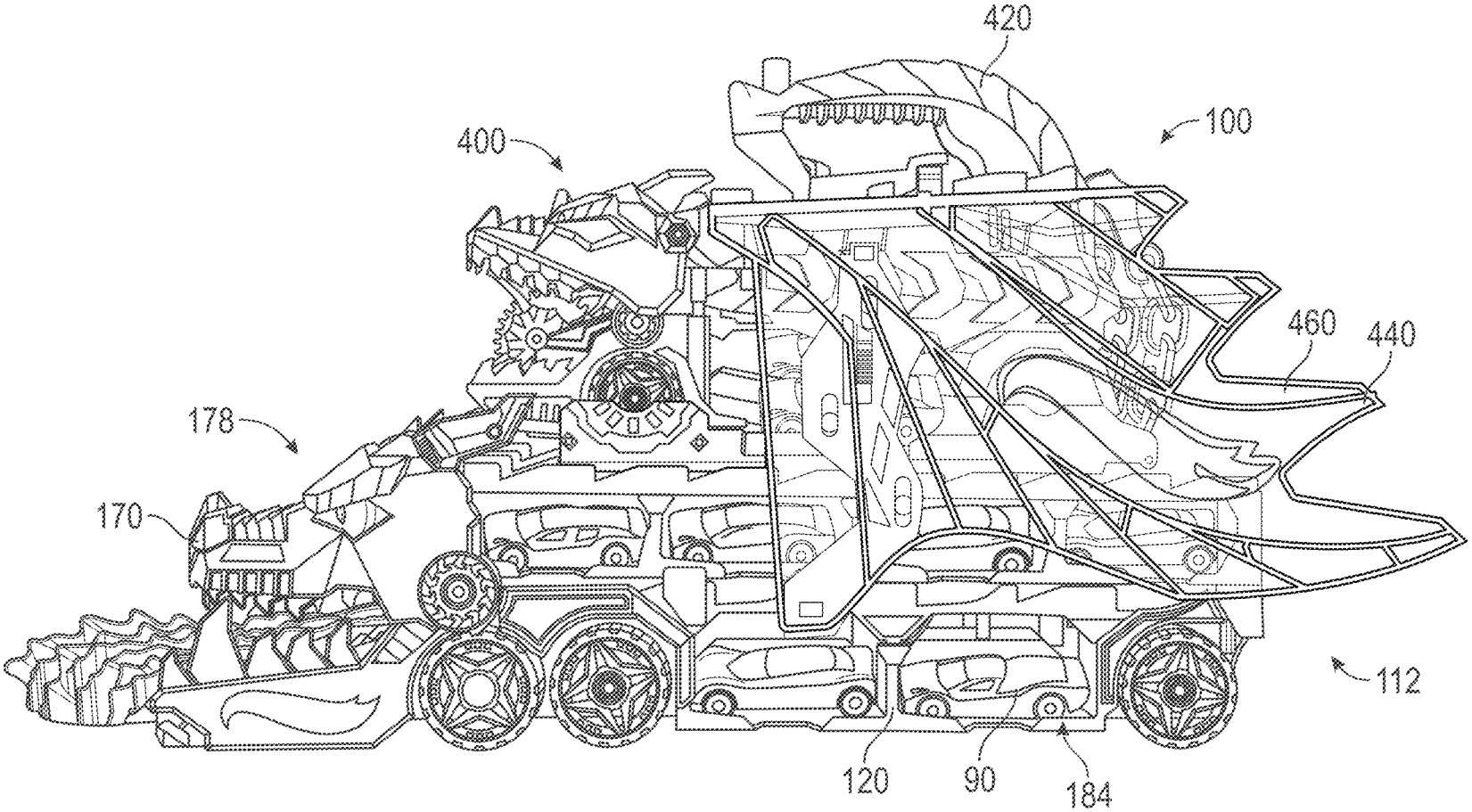
FIG. 3 illustrates a side view of the toy vehicle transporter illustrated in FIG. 2.

Referring to FIG. 3, a side view of the toy vehicle transporter 100 shown in FIG. 2 is illustrated. The toy vehicle transporter 100 is shown in its folded or collapsed configuration 112 in FIG. 3 as well. The head member 170 is shown in its lowered position 178 relative to the base portion 120. The base portion 120 includes several cavities or receptacles 184 in which toy vehicles 90 can be placed manually by a child. In the view illustrated in FIG. 3, both of the wings 440 and 460 are illustrated. As a child moves the toy vehicle transporter 100 along a support surface, the removable transporter 400 moves therewith. In particular, a child can grasp the handle 420 and move the handle 420 relative to a support surface to move the toy vehicle transporter 100 as well.

Figure 4:
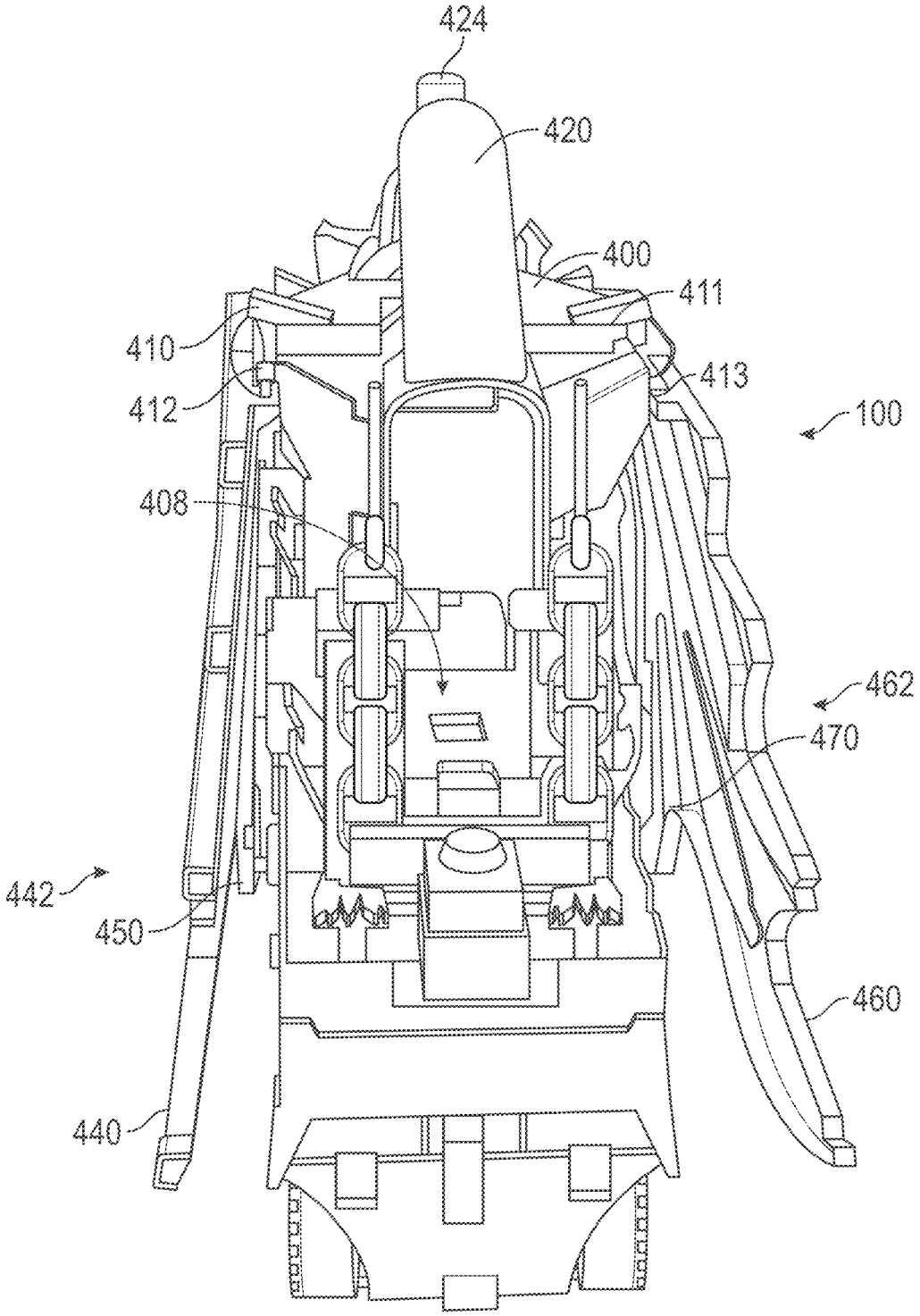
FIG. 4 illustrates a rear view of the toy vehicle transporter illustrated in FIG. 2.

Turning to FIG. 4, a rear view of toy vehicle transporter 100 is illustrated. An opening 408 into an internal cavity or receptacle in the body 402 of the removable transporter 400 is sized so that a user can insert a toy vehicle through opening 408 into the cavity or receptacle. The removable transporter 400 has sides 410 and 411 on opposite sides of the handle 420. Side 410 has a mount or mounting portion 412 to which wing 440 is pivotally coupled. Similarly, side 411 has a mount or mounting portion 413 to which wing 460 is pivotally coupled. In this configuration, the wings 440 and 460 are disposed in their lowered positions 442 and 462, respectively. Wing 440 is coupled to a latch member 450 that is pivotally coupled to the body 402. Similarly, wing 460 is coupled to a latch member 470 that is pivotally coupled to the body 402. As described in detail below, each of the latch members 450 and 470 is movable between a lowered position and a raised or extended position relative to the body 402. In FIG. 4, each of the latch members 450 and 470 is in its lowered position.

When a child engages and presses downwardly on the actuator 424, the latch members 450 and 470 are moved downwardly relative to the body 402 so that latches on the latch members 450 and 470 can disengage from catches on the body 402, thereby allowing the latch members 450 and 470 to move upwardly under the biasing force of springs from their lowered positions to their raised positions.

Figure 5:
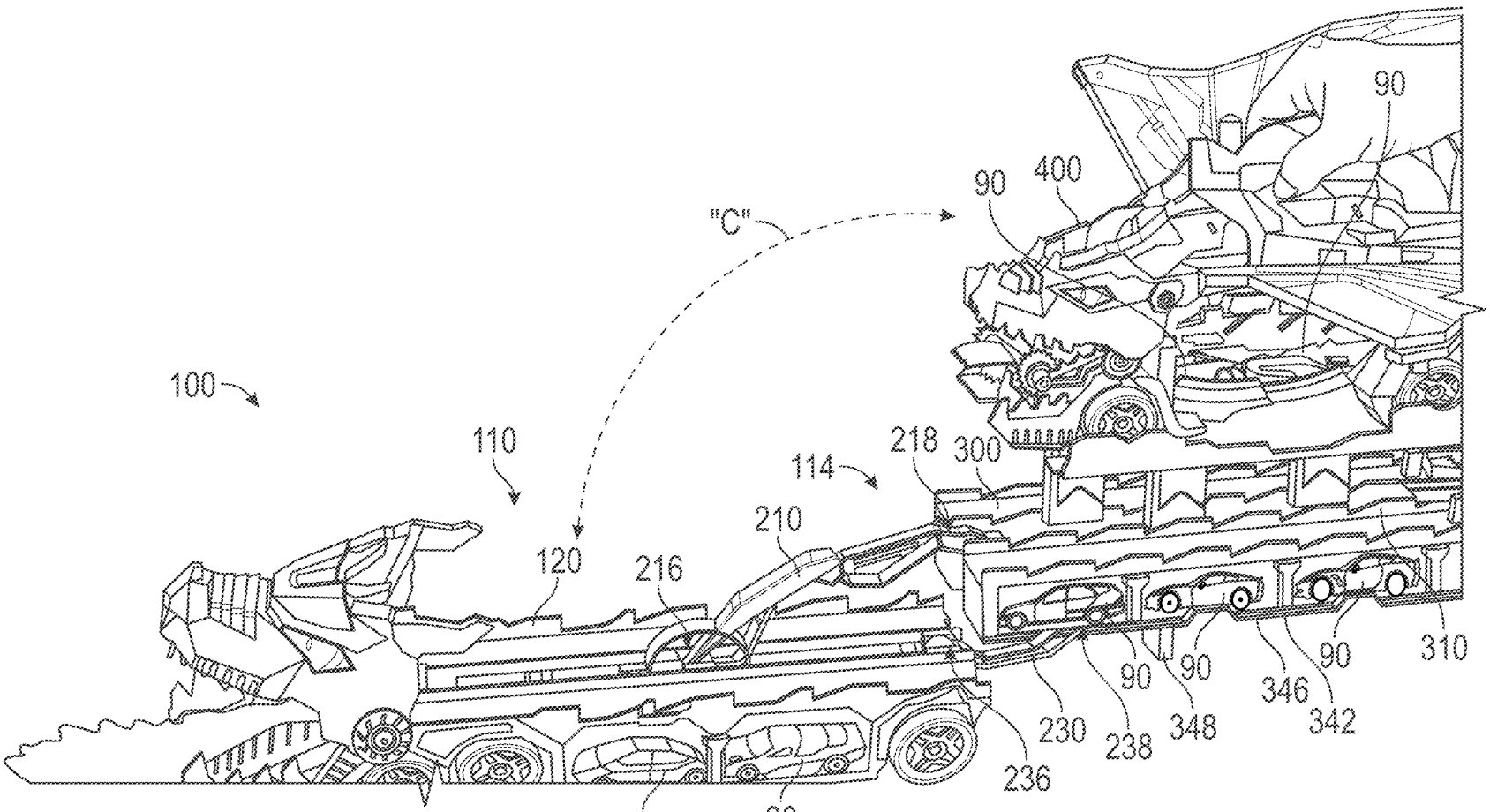
FIG. 5 illustrates a perspective view of some components of the toy vehicle transporter illustrated in FIG. 2 in a different configuration.

Turning to FIG. 5, some of the reconfiguration of the toy vehicle transporter 100 is illustrated. The base portion 120 is placeable on a support surface, and includes several toy vehicles 90 disposed in cavities therein. The toy vehicle transporter 100 includes a repositionable portion 300 that is movable relative to the base portion 120. In FIG. 5, the location of the repositionable portion 300 is such that the transporter 110 is in an intermediate configuration 114. The transporter 110 includes a pair of arms 210 and 230, which can be referred to as couplers, each of which is connected to both the base portion 120 and the repositionable portion 300. The arms 210 and 230 are coupled to each of the base portion 120 and the repositionable portion 300 in a manner to avoid fingers of a child from being pinched by the arms 210 and 230. Arm 210 is connected to base portion 120 at location 216. Arm 230 is connected to base portion 120 at location 236, which in this embodiment, is located closer to the rear end of base portion 120 than location 216. Similarly, arm 210 is connected to repositionable portion 300 at location 218. Arm is connected to repositionable portion 300 at location 238, which in this embodiment is located closer to the rear end of repositionable portion 300 than location 218. When repositionable portion 300 is moved relative to base portion 120, each of the arms 210 and 230 pivot relative to the portions 120 and 300. Each of the base portion 120 and the repositionable portion 300 has a slot into which the arms 210 and 230 is accommodated so that the arms 210 and 230 are not preventing the base portion 120 and the repositionable portion 300 from being moved relative to each other in a smooth and continuous manner. To move the repositionable portion 300, a user can grasp the handle of the removable transporter 400 while it is coupled to the repositionable portion 300 and move the removable transporter 400 along the direction of arrow "C". That movement causes the arms 210 and 230 to pivot as well.

Repositionable portion 300 includes a body 310 with a lower member 342 that has a lower surface 346 from which several engaging members 348 extend downwardly. When the repositionable portion 300 is positioned on top of the base portion 120, the engaging members 348 contact the upper surface of the base portion 120 and create a space between the lower member 342 and the base portion 120, which reduces the likelihood of a user's fingers or hand being pinched between the repositionable portion 300 and the base portion 120.

Figure 6:
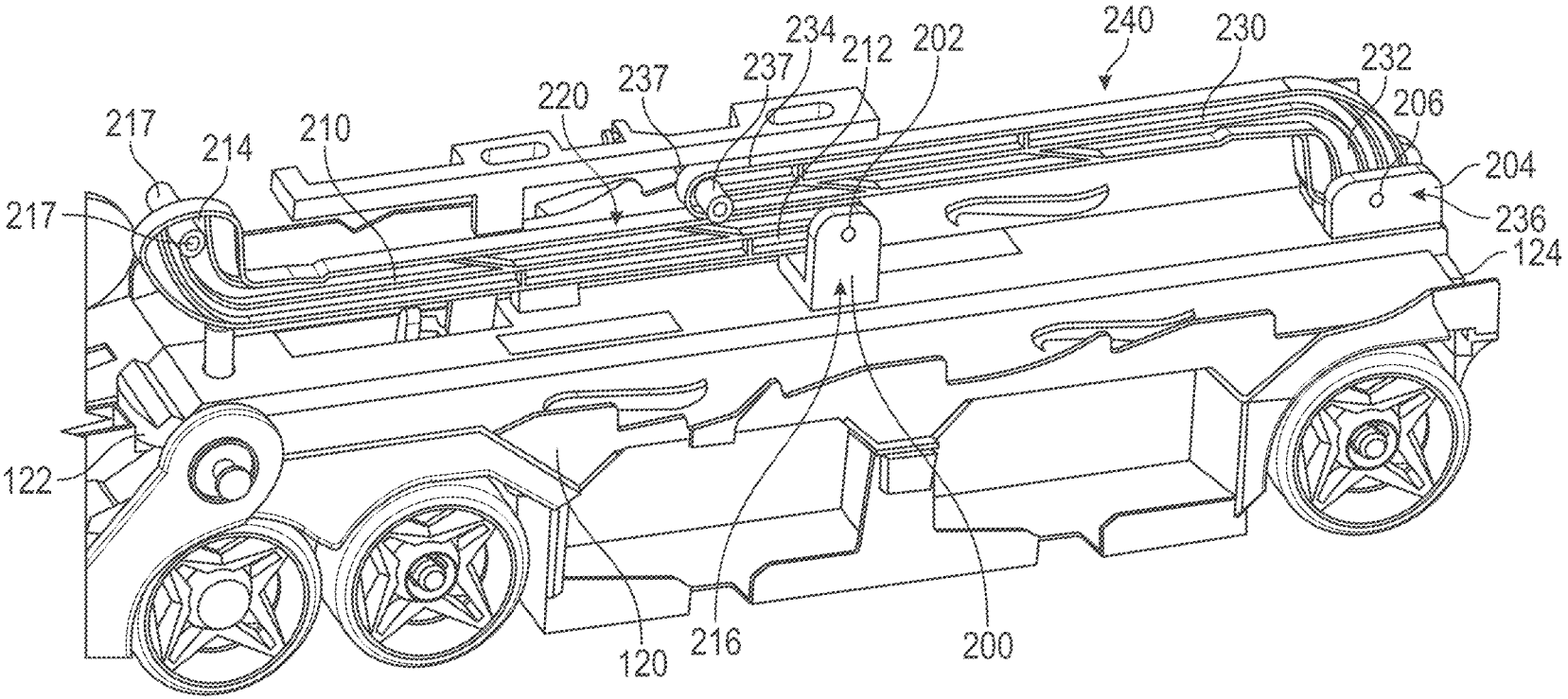
FIG. 6 illustrates a perspective view of a portion of a base of the toy vehicle transporter illustrated in FIG. 2 with several components removed.

Turning to FIG. 6, the base portion 120 has a front end 122 and a rear end 124 opposite to the front end 122. The base portion 120 also includes a mount 200 that has two spaced-apart flanges that contain holes in which a pin 202 extends, and a mount 204 that has two spaced-apart flanges that contain holes through which a pin 206 extends. Arm 210 has opposite ends 212 and 214. End 212 is pivotally coupled to mount 200 via pin 202, which forms the location 216 at which arm 210 is coupled to base portion 120. Arm 210 can be pivoted about an axis defined by pin 202. Arm 210 is shown in FIG. 6 in its folded or retracted position 220. Arm includes a pair of posts 217 that extend in opposite directions at end 214. The posts 217 are pivotally coupled to repositionable portion 300 via recesses in repositionable portion 300 and connectors (not shown).

Similarly, arm 230 has opposite ends 232 and 234. End 232 is pivotally coupled to mount 204 via pin 206, which forms the location 236 at which arm 230 is coupled to base portion 120. Arm 230 can be pivoted about an axis defined by pin 206. Arm 230 is shown in its folded or retracted position 240. Arm includes a pair of posts 237 that extend in opposite directions at end 234. Like posts 217, the posts 237 are pivotally coupled to repositionable portion 300 via recesses in repositionable portion 300 and connectors (not shown).

Figure 7:
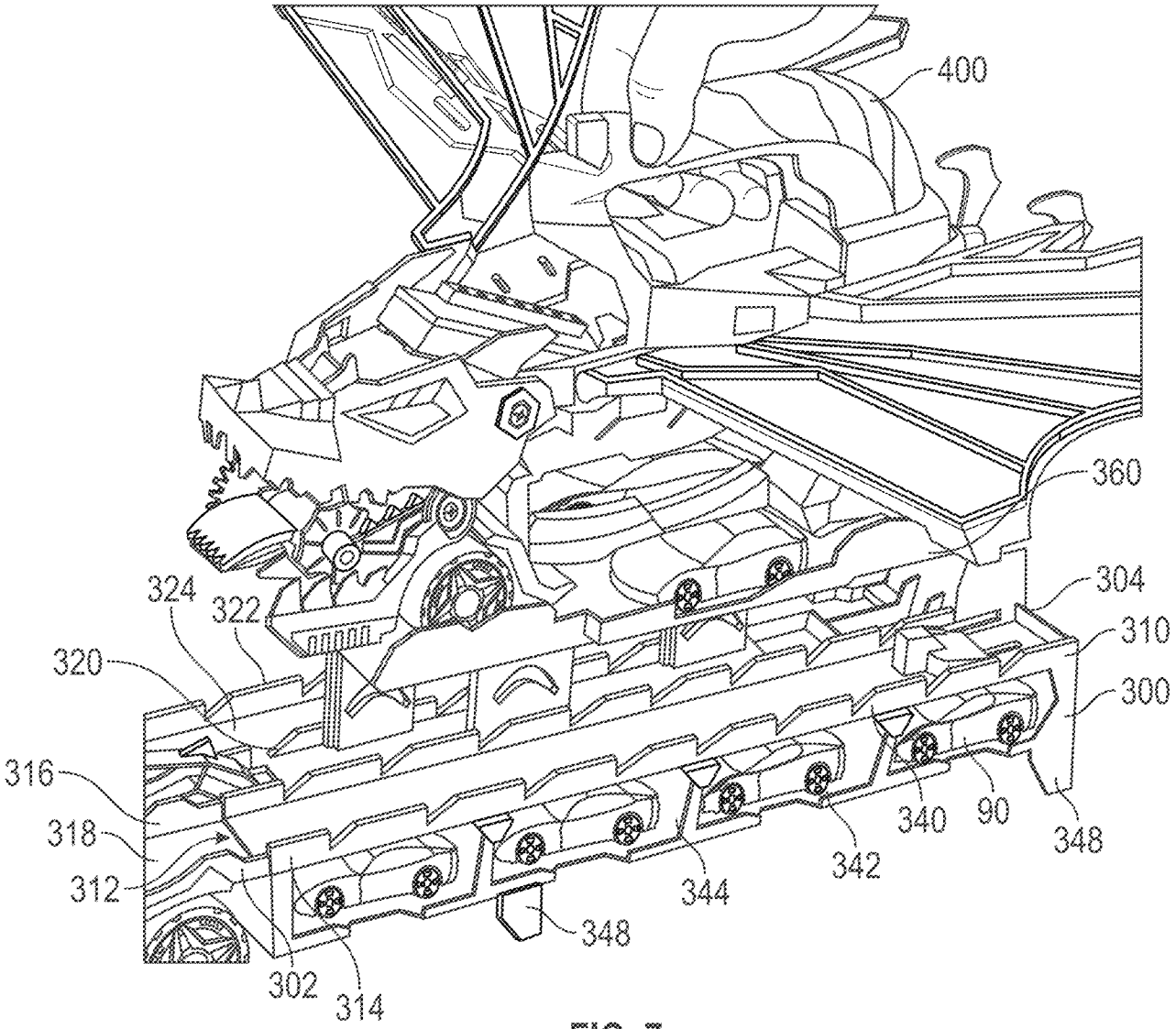
FIG. 7 illustrates a perspective view of a rear portion of the toy vehicle transporter illustrated in FIG. 2 with its portions in their opened positions.

Referring to FIG. 7, the removable transporter 400 is coupled to a coupling platform 360 of the transporter 110 which is in its deployed or unfolded configuration. In this view, the features of repositionable portion 300 are easily viewable. In particular, the repositionable portion 300 has a body 310 that has an upper side or upper surface 312 that extends between a front end 302 and a rear end 304 of the body 310. The upper surface 312 includes a pair of tracks 318 and 324 formed therein. Track 318 is defined between rails 314 and 316. Track 324 is defined between rails 320 and 322. Tracks 318 and 324 are parallel to each other and extend between the front end 302 and the rear end 304. The body 310 includes an upper member 340 and a lower member 342 that define therebetween several cavities or receptacles 344 in which toy vehicles 90 are located. The engaging members 348 extending downwardly from lower member 342 are shown in FIG. 7 as well.

Figure 8:
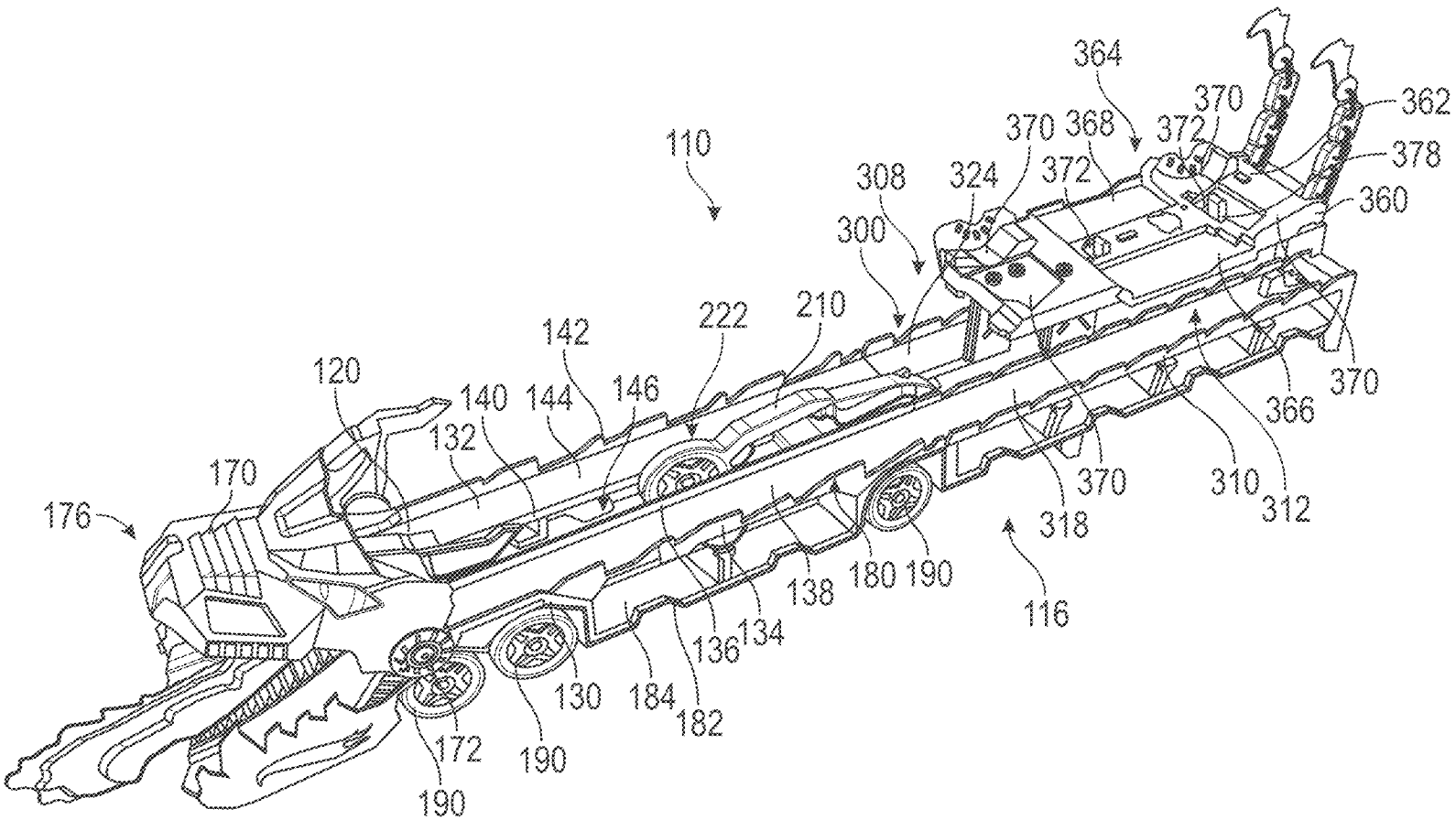
FIG. 8 illustrates a perspective view of a base transporter of the toy vehicle transporter illustrated in FIG. 2 in its unfolded configuration.
Figure 9:
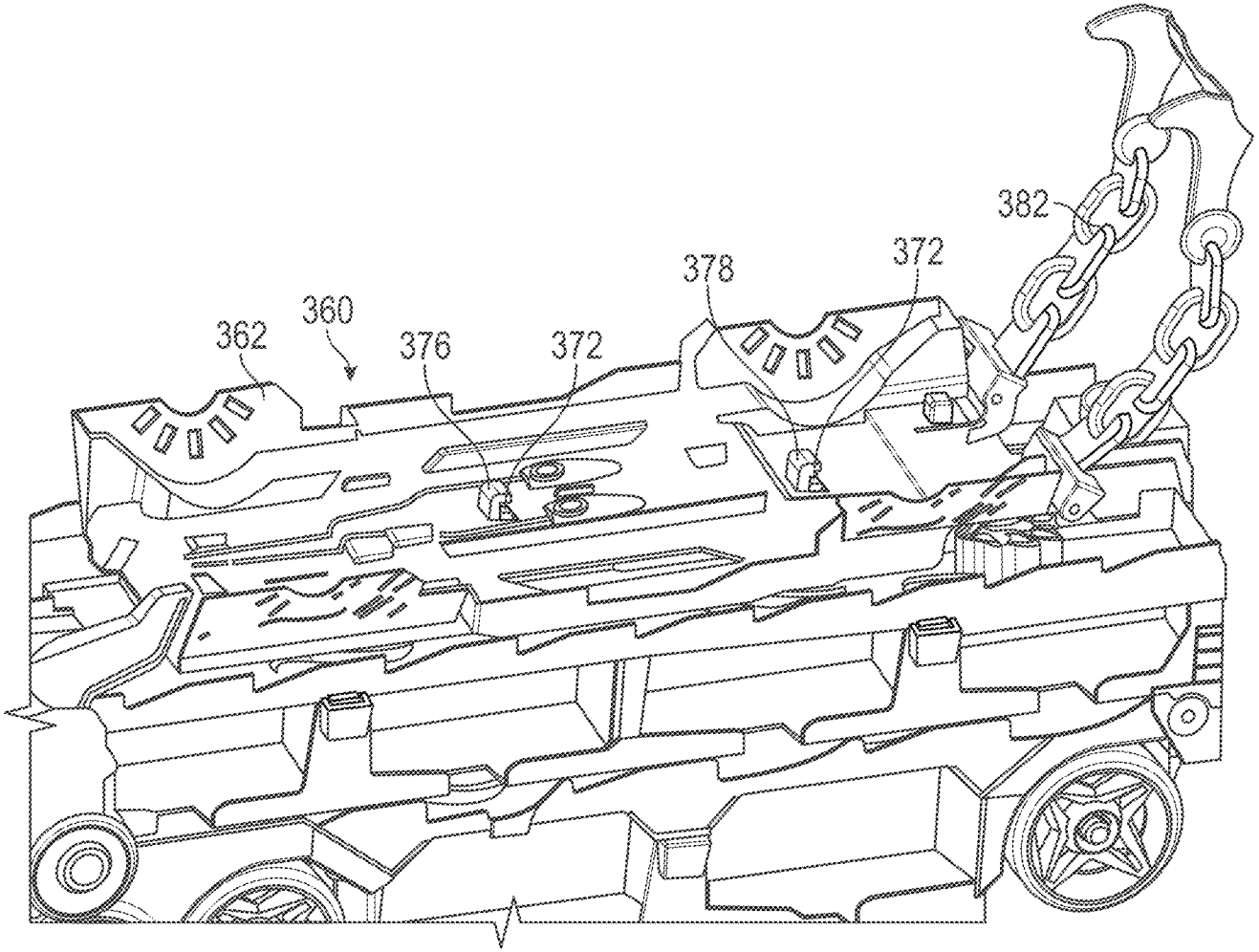
FIG. 9 illustrates a perspective view of a rear portion of the base transporter illustrated in FIG. 8.

Turning to FIGS. 8 and 9, a perspective view of the transporter 110 is illustrated. The transporter 110 is shown in is flat or deployed configuration 116, and is placed on a support surface such that wheels 190 engage the support surface. The base portion 120 has a body 130 with an upper side or upper surface 132 that extends from a front end to a rear end of the body 130. The upper side 132 has a pair of tracks formed therein. Track 138 is defined between rail 134 and rail 136. Track 144 is defined between rail 140 and 142. Located between tracks 138 and 144 is a slot 146 into which arm 210 can be disposed. Arm 210 is shown in its fully opened position 222, which allows repositionable portion 300 to be placed in an end-to-end arrangement with base portion 120. The body 130 includes an upper member 180 and a lower member 182 that define therebetween several cavities or receptacles 184 into which toy vehicles 90 can be located. The head member 170 is pivotally coupled to the base portion 120 via pins or axles 172. The head member 170 is shown in its raised position 176 in FIG. 8.

Repositionable portion 300 is disposed in a position 308 in which it is in an end-to-end arrangement with base portion 120. As shown, the body 310 of the repositionable portion 300 includes the tracks 318 and 324 formed therein.

Coupling platform 360 has a body 362 with several features that receive portions of the removable transporter 400, which has been decoupled from coupling platform 360 in FIG. 8. The body 362 has an upper surface 364 with receptacles 366 and 368 formed therein in which toy vehicles can be placed. The upper surface 364 also includes receptacles 370 for the different wheels of removable transporter 400. The coupling platform 360 also has features that facilitate the coupling of the removable transporter 400 thereto. In particular, body 362 has a pair of spaced-apart slots 372 that are sized so that latches 376 and 378 can extend therethrough and move back and forth therein. A hook member 382 located at the rear end of the base portion is shown in FIG. 9.

Figure 10:
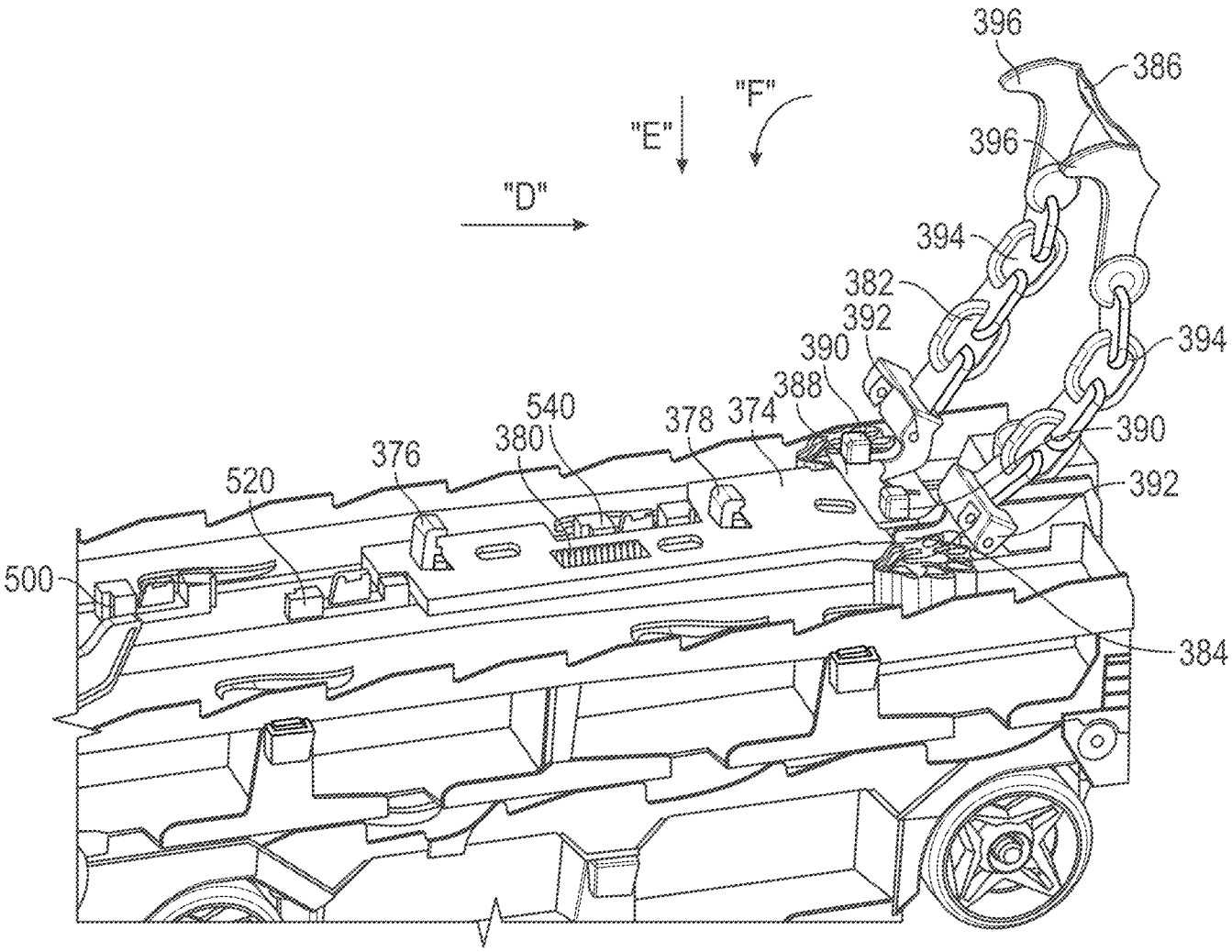
FIG. 10 illustrates a perspective view of the rear portion illustrated in FIG. 8 with some components removed.

Referring to FIG. 10, the body 362 of the coupling platform 360 has been removed to simplify the description of the various components. The repositionable portion 300 includes several supports that are slidably coupled to and move relative to the repositionable portion 300. In particular, the top ends of supports 500, 520, and 540 are shown in FIG. 10. The structures of supports 500, 520, and 540 are described below relative to FIGS. 28 and 29, the movement and function of the supports 500, 520, and 540 are described below relative to FIGS. 30-36.

A lock plate 374 is viewable with body 362 removed. In this embodiment, lock plate 374 has latches 376 and 378 integrally formed thereon. Lock plate 374 has a slot formed therein in which a biasing member 380, such as a spring, is disposed. The biasing member 380 biases the lock plate 374 in the direction of arrow "D", which causes the latches 376 and 378 to remain in openings in the lower surface of removable transporter 400 to couple the removable transporter 400 to the coupling platform 360.

The coupling platform 360 has an engagement member 388 that is movably mounted to the coupling platform 360. The engagement member 388 has a pair of posts 390 that extend upwardly and which are engaged by a lower surface of the removable transporter 400 when the removable transporter 400 is placed on the coupling platform 360. The hook member 382 is pivotally coupled to coupling platform 360 and movable about pins or axles 392. The hook member 382 has a lower end 384 that is engaged by engagement member 388 and an opposite upper end 386. When the removable transporter 400 is placed onto the coupling platform 360, it presses downward on the engagement member 388 along the direction of arrow "E", which in turn presses downward on lower end 384. As a result, that movement causes the hook member 382 to pivot about axles 392 along the direction of arrow "F". The hook member 382 has two body portions 394, each of which terminates in a hook 396. When the hook member 382 rotates, the hooks 396 engage the removable transporter 400, and the top of the hook member 382 can be used as a handle.

Figure 11:
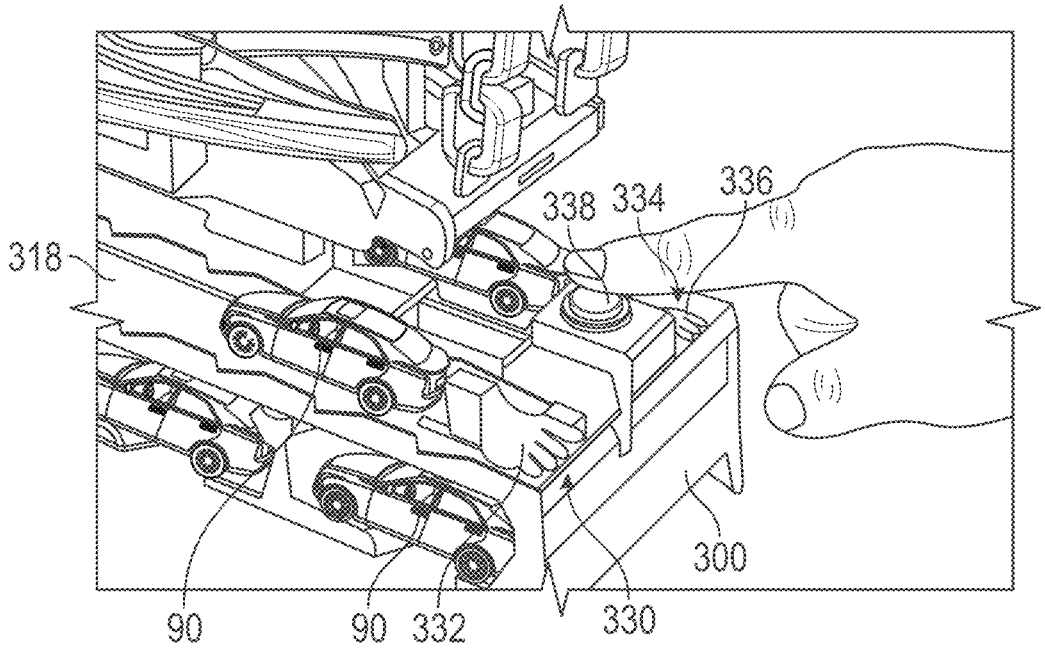
FIG. 11 illustrates a perspective view of a rear portion of the base transporter illustrated in FIG. 8.

Turning to FIG. 11, the launching of toy vehicles is described. In this view, a rear portion of the repositionable portion 300 is shown. The repositionable portion 300 includes a first launcher 330 associated with track 318 and a second launcher 334 associated with track 324 (not shown in FIG. 11). Launcher 330 has an engagement member 332 that is biased into engagement with a toy vehicle 90 located on track 318. Similarly, launcher 334 has an engagement member 336 that is biased into engagement with a toy vehicle on track 324. The engagement members 332 and 336, which are retained by catches in their loaded positions against the bias of one or more springs, are simultaneously released when a user presses downward on button or actuator 338 to releases the catches. As a result, when the toy vehicles 90 are propelled along tracks 318 and 324, the toy vehicles 90 travel from the rear end of the transporter 110 to the front end of the transporter 110.

Figure 12:
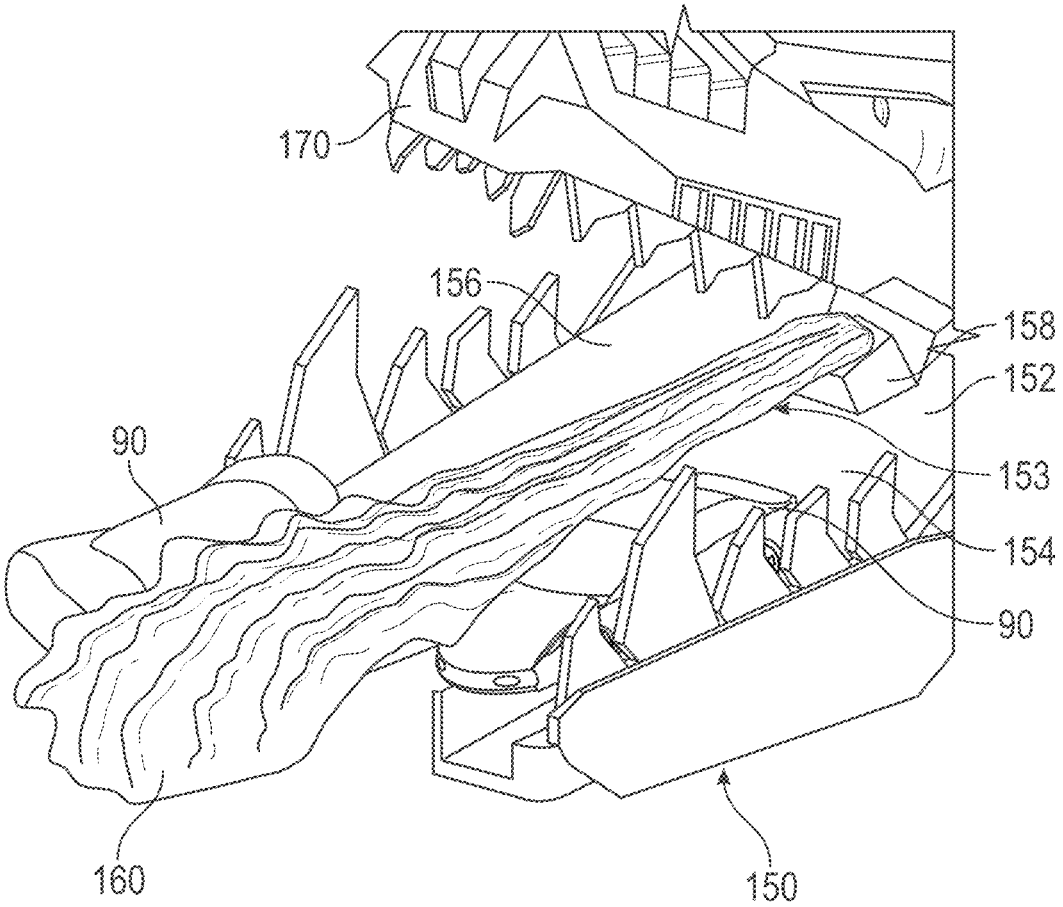
FIG. 12 illustrates a perspective view of a front portion of the toy vehicle transporter illustrated in FIG. 2.

Referring to FIG. 12, the front end portion 150 of the transporter 110 is illustrated. The front end portion 150 includes a lower ramp portion 152 located beneath the head member 170. The tongue 160 is located in a slot 158 in the lower ramp portion 152, which is located between tracks 154 and 156. Track 154 is in communication with track 138 and track 318. As a result, a toy vehicle 90 can be propelled by launcher 330 along track 318, then track 138, and then track 154. Similarly, track 156 is in communication with track 144 and 324. The base has an outlet opening 153 that is in communication with the track 154. As a result, a toy vehicle 90 can be propelled by launcher 334 along track 324, then track 144, and then track 156.

Figure 13:
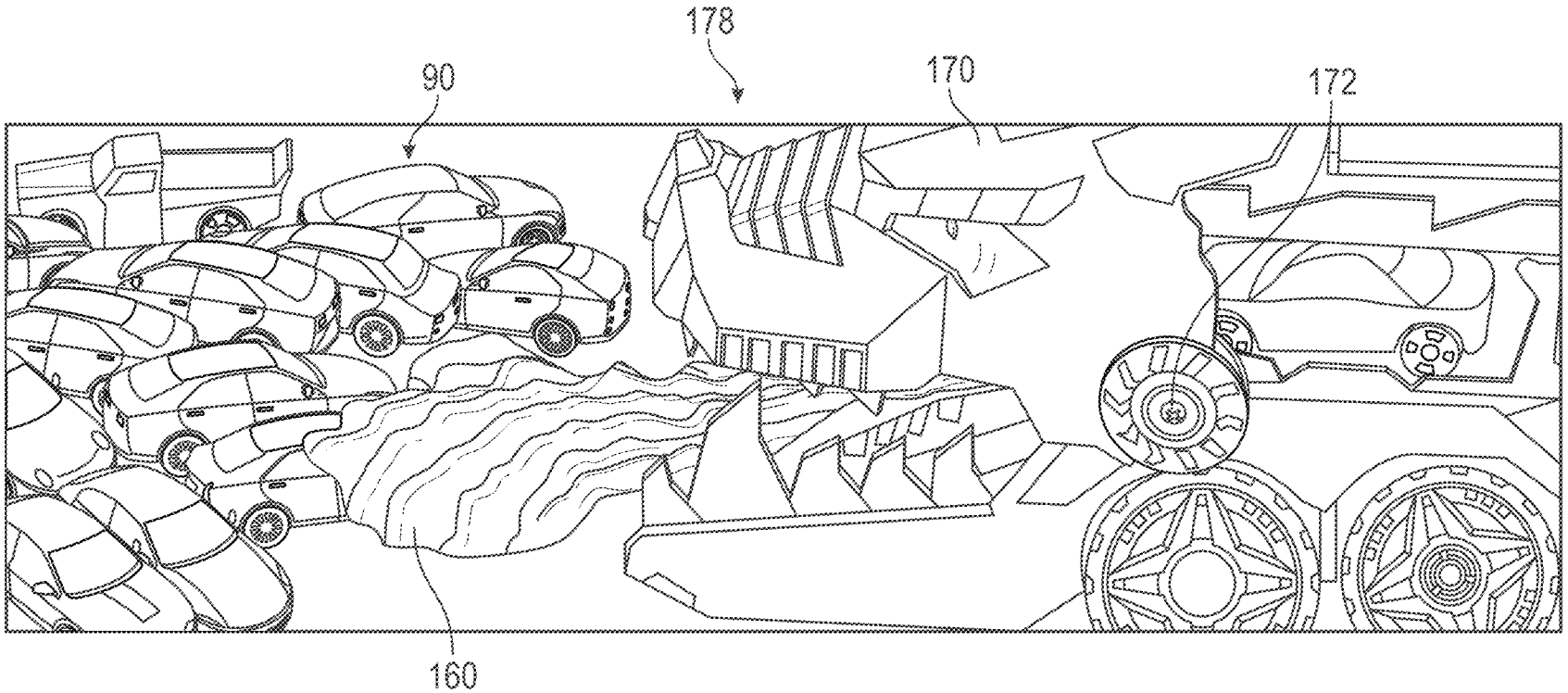
FIG. 13 illustrates a side view of the front portion illustrated in FIG. 12 engaging toy vehicles.
Figure 14:
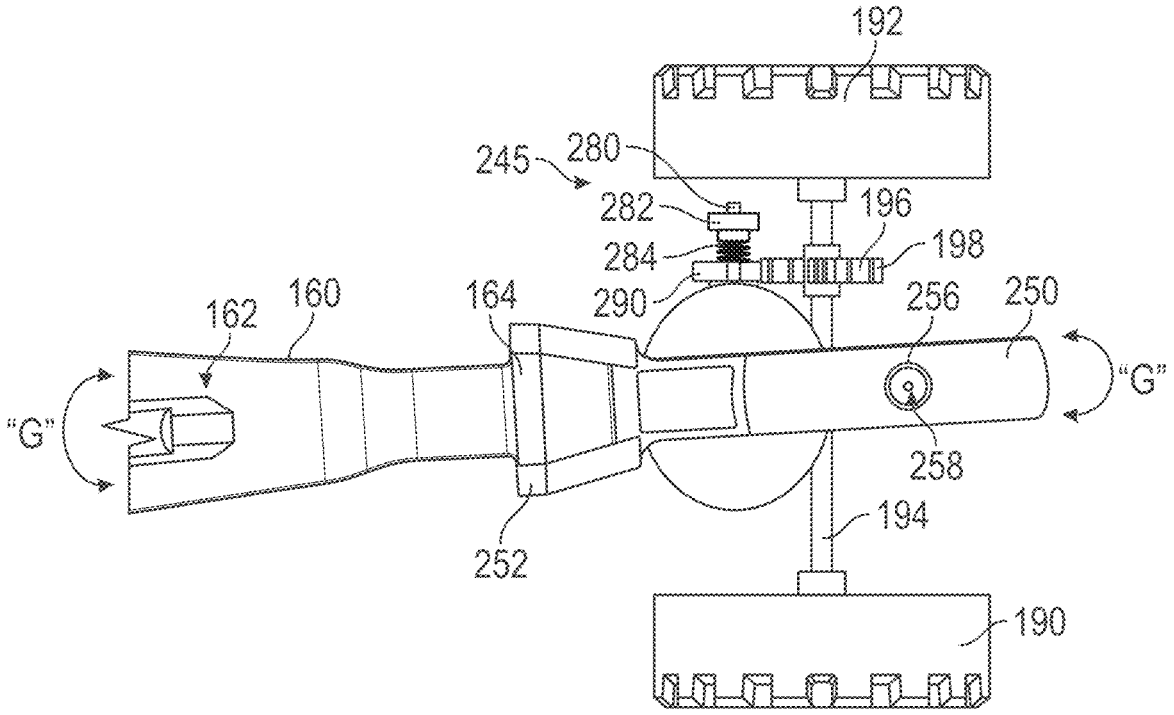
FIG. 14 illustrates a top view of some components of a tongue moving assembly of the toy vehicle transporter illustrated in FIG. 2.

As described in detail below, the tongue 160 moves side-to-side relative to the front end of the toy vehicle transporter 100. In FIG. 13, the head member 170 has pivoted downwardly around axle 172 to its lowered position 178. When the transporter 110 is moved along a support surface, its wheels rotate, which drives a gear as an input to a drive assembly that causes the tongue 160 to move side-to-side.

Turning to FIGS. 14-19, an embodiment of a drive assembly according to a present invention is illustrated. Initially referring to FIG. 14, a top view of some components of the drive assembly 245 are shown. The tongue 160 has an upper surface 162 and an end 164 that is insertable into a front end 252 of a driving member 250. The driving member 250 is mounted for reciprocating movement. The driving member 250 also includes an upwardly extending rod 256 that defines a pivot axis 258 about which the driving member 250 reciprocates back and forth along the directions of arrows "G".

Coupled to the base portion 120 is an axle 194 that rotates about its longitudinal axis. Wheels 190 and 192 are mounted to opposite ends of the axle 194. Also coupled to the axle 194 is a gear 196 that has several teeth 198 around its perimeter, and which rotates with the axle 194 about that axle's longitudinal axis.

The drive assembly includes another axle 280 that is parallel to axle 194. A fixed sleeve 282 is mounted to the axle 280. A biasing member 284, such as a coil spring, is engaged with the fixed sleeve 282. The biasing member 284 also engages a gear 290 that is mounted on the axle 280. The teeth of gear 290 engage the teeth 198 of gear 196. Rotation of gear 196 results in teeth 198 driving the teeth of gear 290, which rotates axle 280 about its longitudinal axis.

Figure 15:
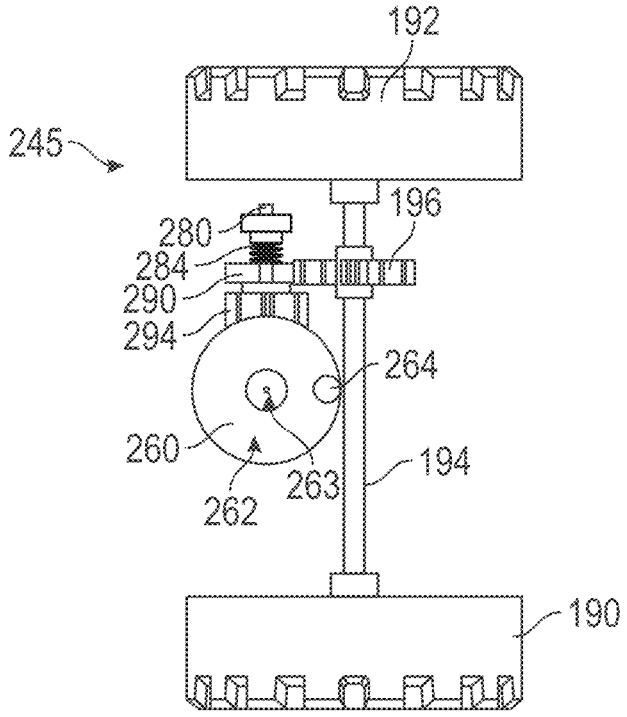
FIG. 15 illustrates another top view of some components of the tongue moving assembly of the toy vehicle transporter illustrated in FIG. 2.

Turning to FIG. 15, different components of the drive assembly 245 are illustrated. FIG. 15 is a top view showing the components relative to wheels 190 and 192 and axle 194. The drive assembly 245 includes another gear 294 mounted on axle 280. The biasing member 284 biases gear 290 into engagement with gear 294 so that crown teeth formed on gear 290 are biased into engagement with crown teeth formed on gear 294. As a result, the rotation of gear 290 directly causes gear 294 to rotate as well. Located proximate to gear 294 is a crown gear 260 that rotates about a pivot axis 263. The crown gear 260 has an upper surface 262 from which a post 264 extends upwardly. The post 264 is eccentrically mounted relative to the pivot axis 263.

Figure 16:
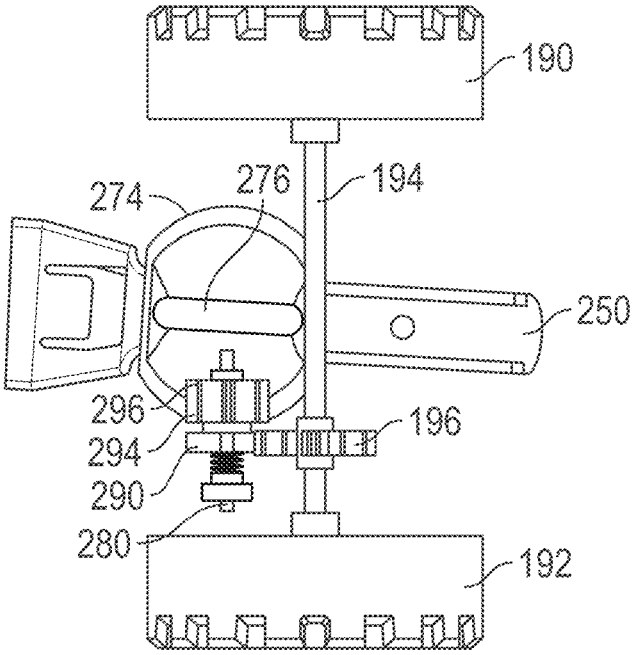
FIG. 16 illustrates a bottom view of some components of the tongue moving assembly of the toy vehicle transporter illustrated in FIG. 2.

Turning to FIG. 16, a bottom view of some of the components of the drive assembly 245 is illustrated. In this view, the relative positions of the gears 196, 290, and 294, axle 280, and axle 194 between wheels 190 and 192 are shown. Gear 294 includes a series of teeth 296 around its perimeter as well. The driving member 250 includes a body with a downwardly extending wall 274 and a slot 276 that receives the post 264. When the crown gear 260 rotates, the post 264 moves relative to pivot axis 263 as well. Post 264 moves back and forth in slot 276 and rotates about axis 263, which drives the body of the driving member 250 to reciprocate about pivot axis 258.

Figure 17:
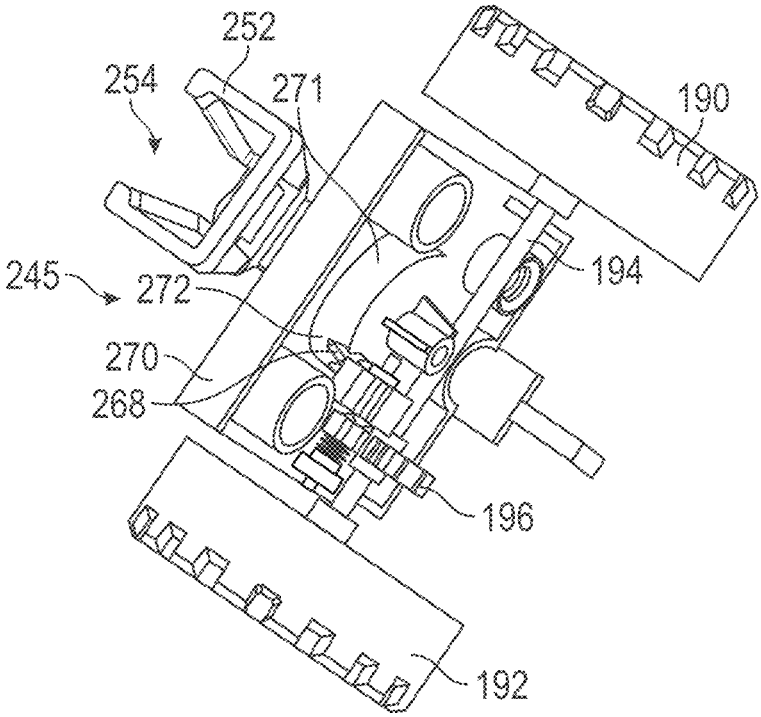
FIG. 17 illustrates a bottom perspective view of some components of the tongue moving assembly of the toy vehicle transporter illustrated in FIG. 2.
Figure 18:
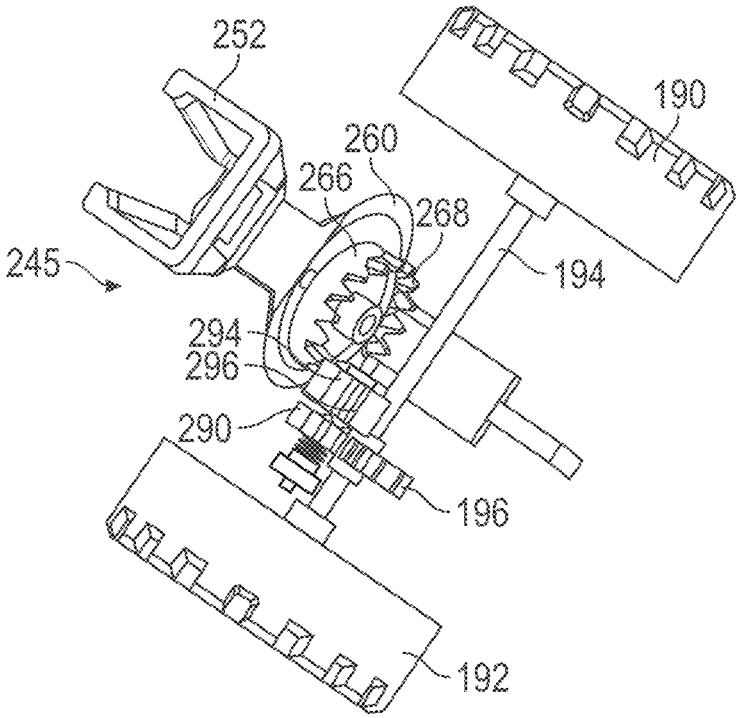
FIG. 18 illustrates another bottom perspective view of some other components of the tongue moving assembly of the toy vehicle transporter illustrated in FIG. 2.

Turning to FIGS. 17 and 18, perspective views of different components of the drive assembly 245 are shown. Front end 252 of driving member 250 has an opening 254 formed therein, into which end 164 of the tongue 160 is inserted. As shown in FIG. 17, the drive assembly 245 includes a gear housing 270 that has a downwardly extending lower portion 271 that has an opening 272 formed therein. The gear housing 270 is removed in FIG. 18, which shows the crown gear 260. The crown gear 260 has a lower end 266 with downwardly oriented teeth 268. Due to the opening 272, teeth 268 of crown gear 260 engage the teeth 296 of gear 294. Thus, when the ground engaging members or wheels 190 and 192 rotate, axle 194 rotates. Due to the engagement of the teeth between the different gears of drive assembly 245, when axle 194 rotates, gear 196 rotates, gear 290 rotates, gear 294 rotates, and crown gear 260 rotates.

Figure 19:
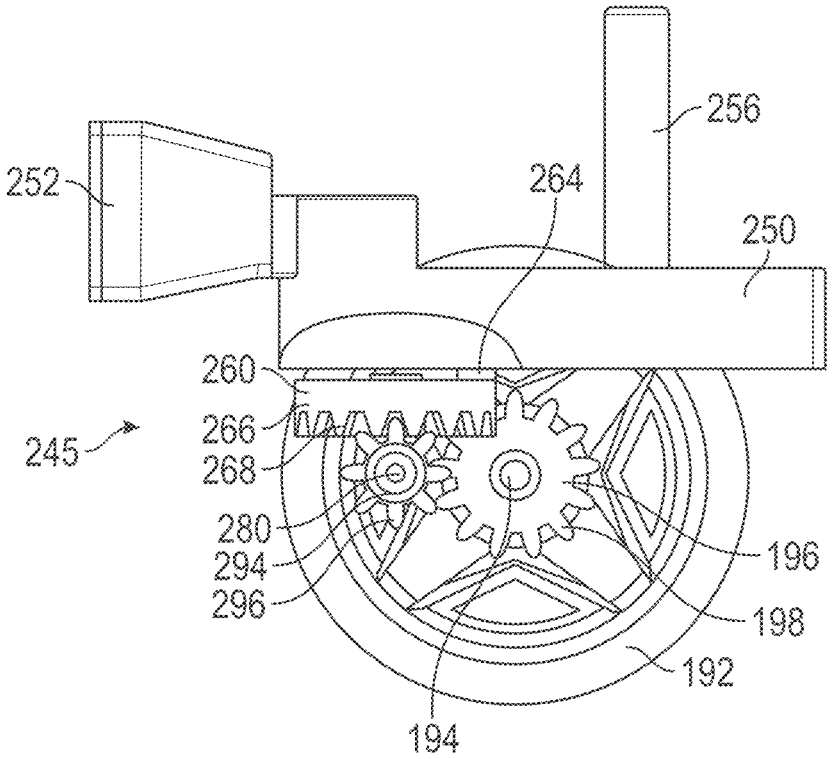
FIG. 19 illustrates a side view of some components of the tongue moving assembly of the toy vehicle transporter illustrated in FIG. 2.

A side view of some components of drive assembly 245 is shown in FIG. 19. The front end 252 and the upwardly extending rod 256 of the driving member 250 are illustrated. The post 264 of the crown gear 260 that engages the driving member 250 as described above extends upwardly while the lower end 266 have teeth 268 extending in the opposite direction. The axles 194 and 280 and wheel 192 are shown in a side view. The profiles of gear 196 with teeth 198 and gear 294 with teeth 296 are also shown.

Figure 20:
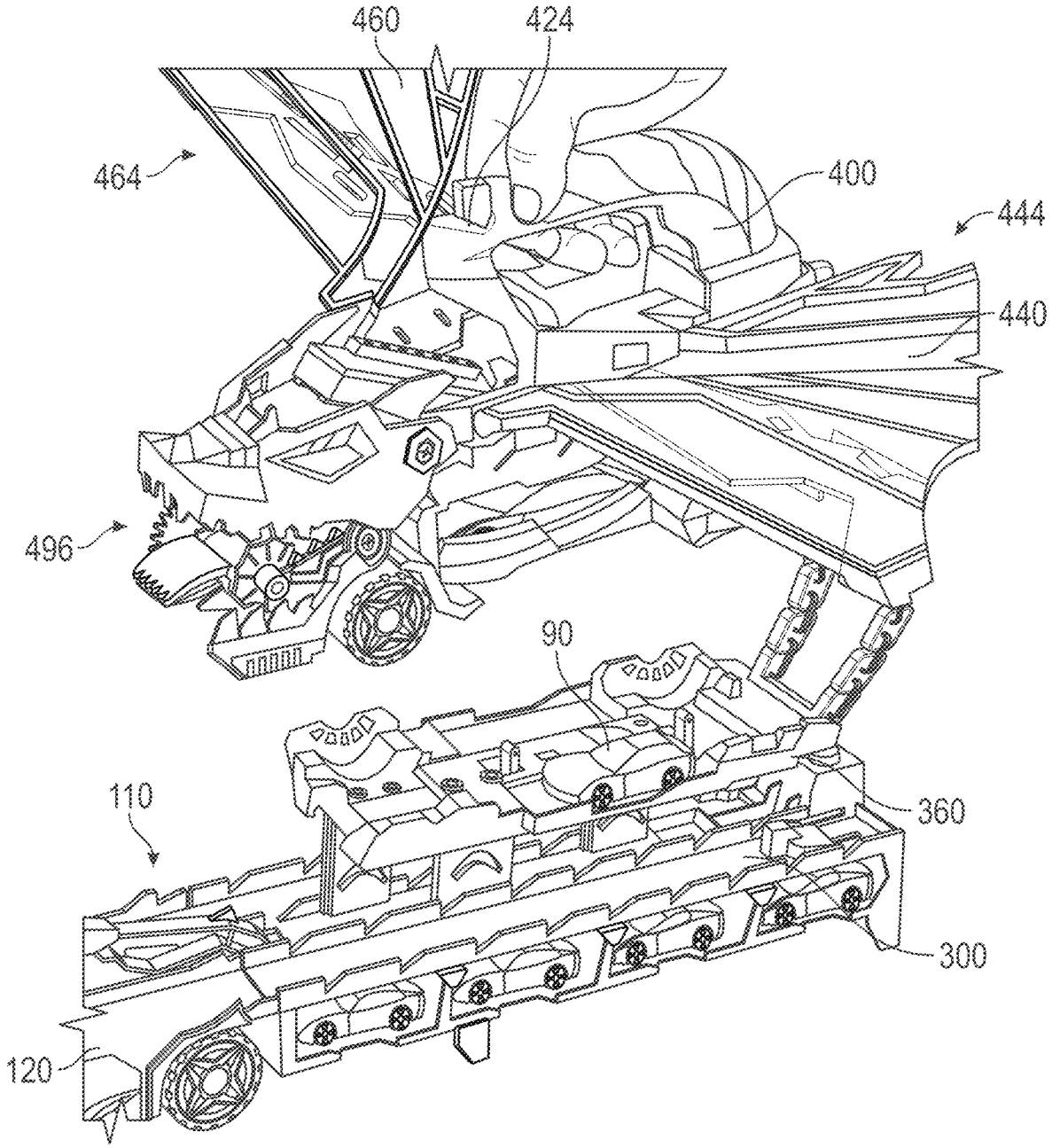
FIG. 20 illustrates a perspective view of a rear portion of the toy vehicle transporter illustrated in FIG. 2 with a removable transporter decoupled from the base transporter.

Turning to FIG. 20, a perspective view of a rear portion of the transporter 110 is illustrated. The repositionable portion 300 is located in an end-to-end relationship with base portion 120. The coupling platform 360 engaged with repositionable portion 300 has a toy vehicle 90 positioned thereon. The removable transporter 400 has been decoupled from the coupling platform 360 and is being held by a user in a decoupled position 496. The user has pressed downward on the actuator 424, which causes the wings 440 and 460 to move upwardly to their raised positions 444 and 464, respectively.

Figure 21:
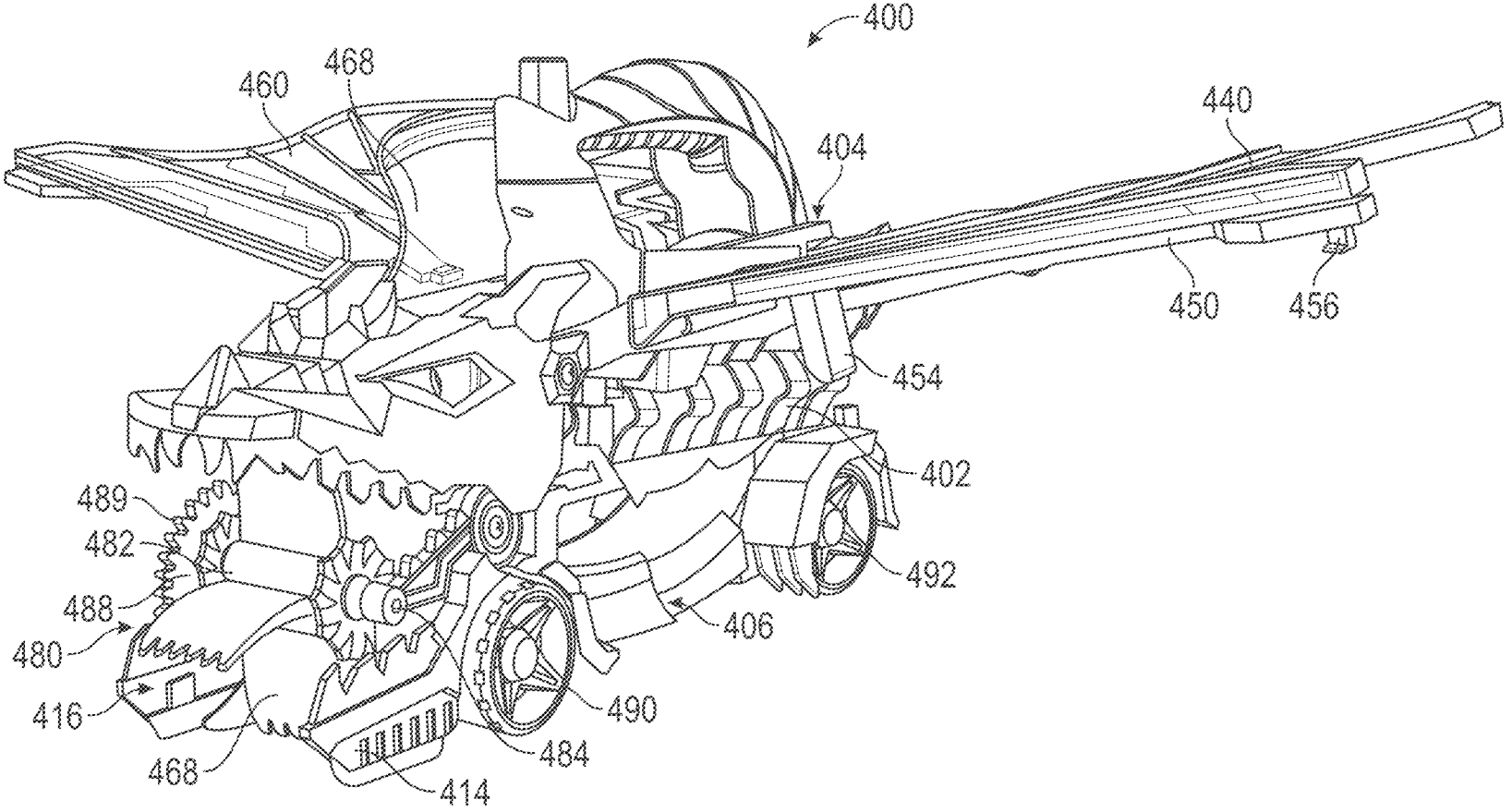
FIG. 21 illustrates a perspective view of an embodiment of a removable transporter according to the present disclosure.

The removable transporter 400 can be used on a support surface on its own without toy vehicle transporter 100. A perspective view of the removable transporter 400 by itself is illustrated in FIG. 21. The removable transporter 400 has a body 402 with an upper portion 404 and a lower portion 406. Coupled to a front end of the lower portion 406 are a left side jaw member 414 and a right side jaw member 416. The toy vehicle collector 480 is located between the jaw members 414 and 416, which guide toy vehicles toward the toy vehicle collector 480 when the removable transporter 400 is pushed along a support surface. The toy vehicle collector 480 includes a hub 482 that is rotatably mounted on axle 484. Extending radially outward from the hub 482 are several paddles 486. As the hub 482 rotates, the paddles move with the hub 482 around the longitudinal axis of the axle 484. A drive gear 488 with teeth 489 is rotatable mounted to the body 402. The drive gear 488 is driven by a gear that rotates as the front wheels 490 rotate as the removable transporter 400 moves along a support surface. There is a pair of rear wheels 492 mounted to the body 402 as well. In FIG. 21, the wings 440 and 460 are in their raised positions. Wing 440 is coupled to latch member 450 and moved therewith. The latch member 450 has an engagement member 454 and a latch 456. As described in greater detail below, each of the wings has a track formed therein. As shown, track 468 in wing 460 is configured to receive a toy vehicle.

Figure 22:
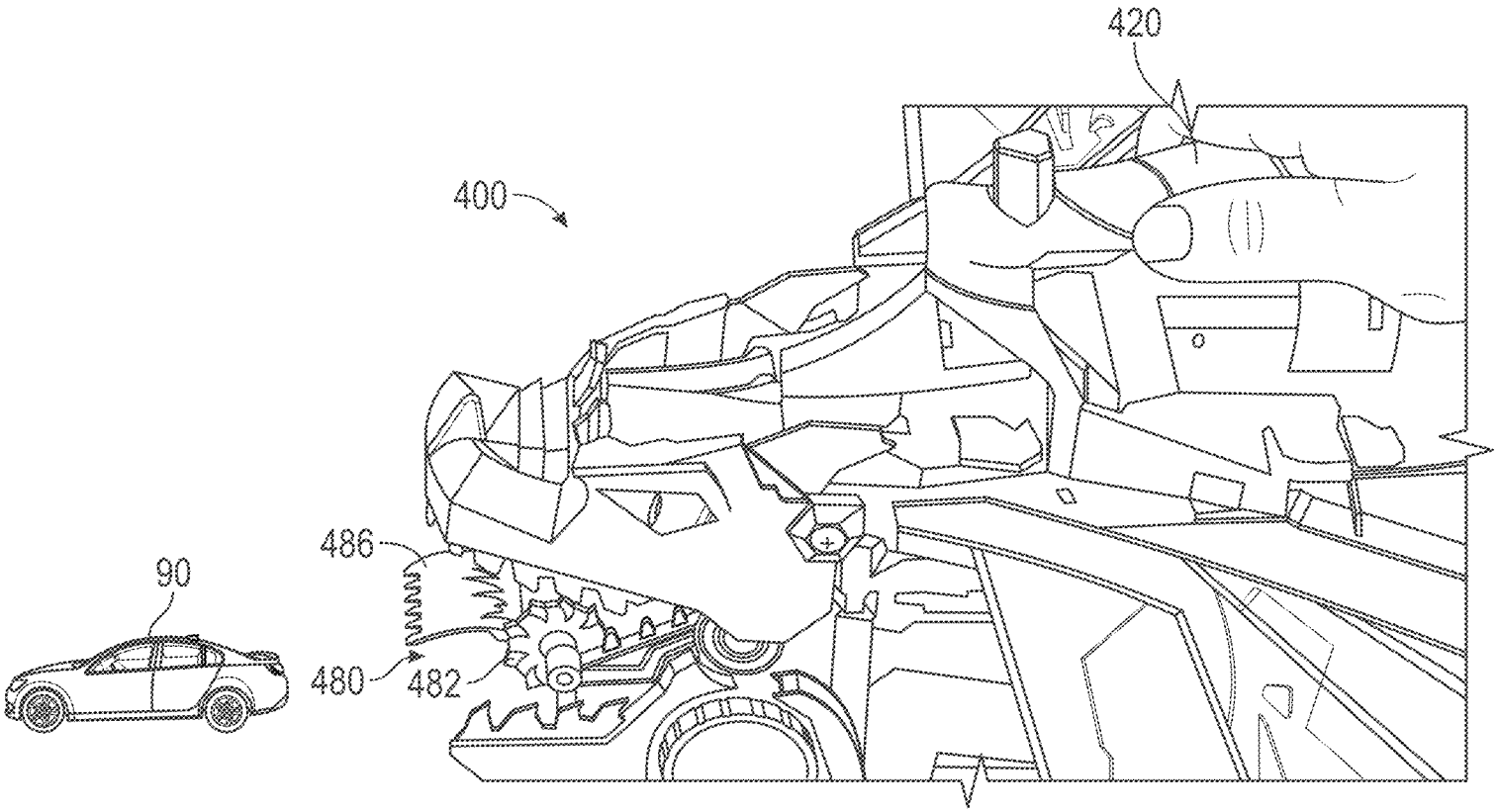
FIG. 22 illustrates a perspective view of a front portion of the removable transporter illustrated in FIG. 21.

Turning to FIG. 22, a user has grasped handle 420 and is moving the removable transporter 400 along a support surface. As the removable transporter 400 is pushed along the support surface, toy vehicles 90 can be collected by the toy vehicle collector 480. The rotation of the front wheels of the removable transporter 400 causes the hub 482 and its paddles 486 to rotate, with the paddles 486 scooping the toy vehicles 90 into an internal cavity or receptacle of body 402.

Figure 23:
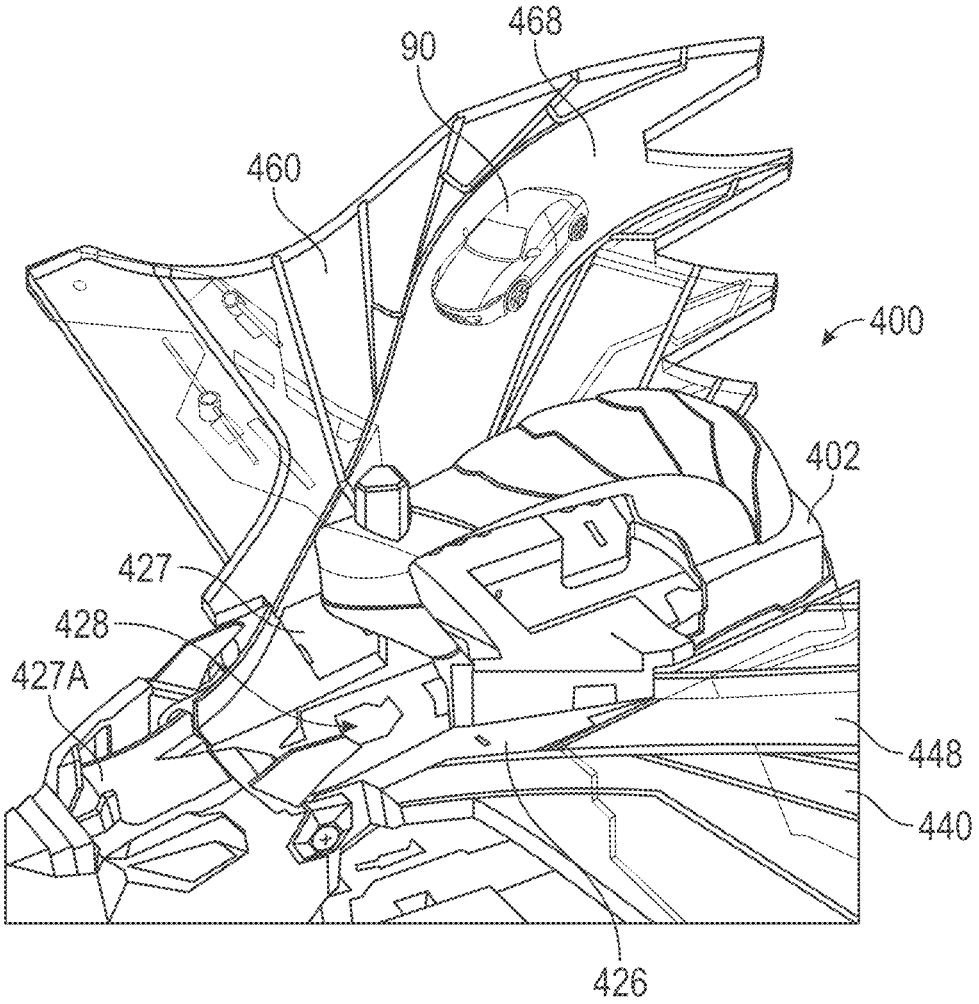
FIG. 23 illustrates a perspective view of a rear portion of the removable transporter illustrated in FIG. 21.
Figure 24:
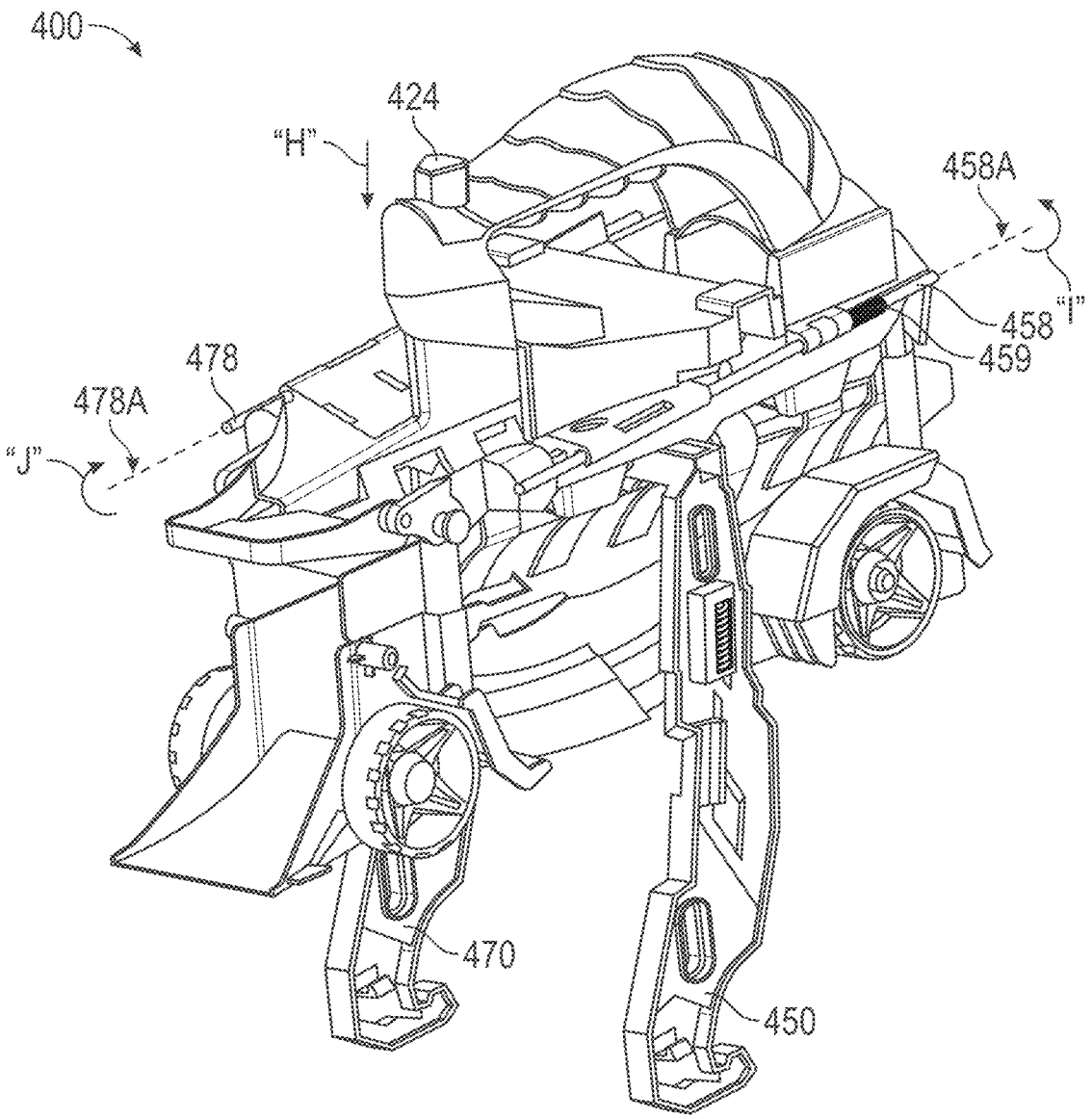
FIG. 24 illustrates a perspective view of the removable transporter illustrated in FIG. 21 with some components removed.

Turning to FIG. 23, some of the various paths for the toy vehicles on removable transporter 400 are shown. The track 468 on wing 460 has a toy vehicle 90 traveling therealong. Toy vehicle 90 can exit track 468 into track entrance 427 and then into track section 427A from which the toy vehicle 90 travels downwardly into a cavity or receptacle 428 in body 402. Similarly, wing 440 has a track 448 formed therein. A toy vehicle can exit track 448 into track entrance 426 and then into track section 427A and subsequently into receptacle 428.

Referring to FIGS. 24-26B, the movement of wings 440 and 460 (while not shown in all of those drawings) is described in greater detail. In those figures, some components of the removable transporter 400 are shown. Initially referring to FIG. 24, wings 440 and 460 (not shown) are coupled to latch members 450 and 470, respectively, which are shown in their lowered positions. When a user presses on actuator button 424 along the direction of arrow "H", the latch members move downwardly along the direction of arrow "H" as well and are released from catches, which enables the wings 440 and 460 and their latch members 450 and 470 to pivot upward relative to the body 402.

Wing 440 is rotatably mounted to a rod 458 that has a longitudinal axis 458A. A biasing member 459, such as a spring, is mounted on the rod 458 and biases the wing 440 around the longitudinal axis 458A in the direction of arrow "I". Similarly, wing 460 is rotatably mounted to a rod 478 that has a longitudinal axis 478A. A biasing member (not shown in FIG. 24) is mounted on the rod 478 and biases the wing 460 around the longitudinal axis 478A in the direction of arrow "I".

Figure 25:
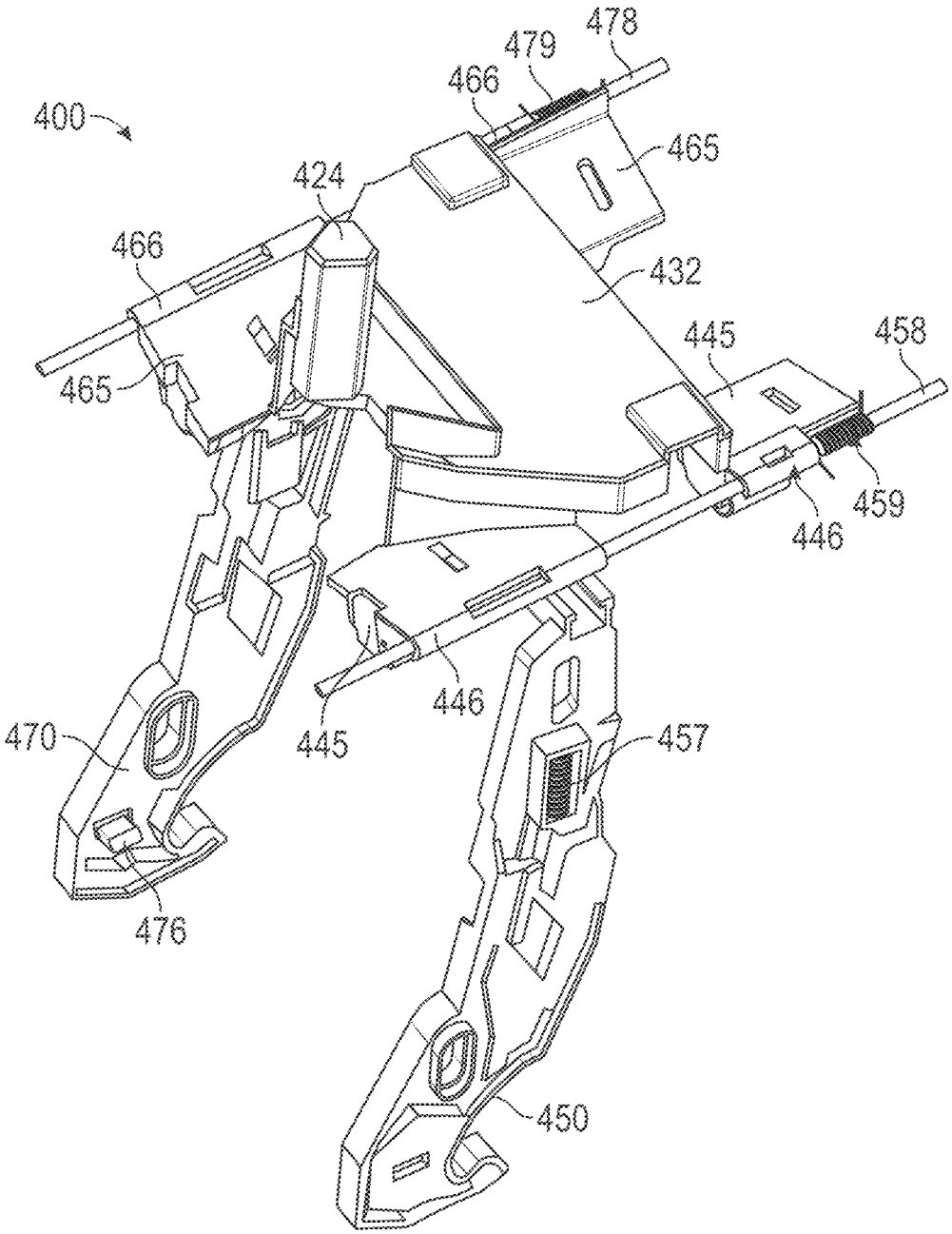
FIG. 25 illustrates a top perspective view of the wing moving mechanism of the removable transporter illustrated in FIG. 21 with some components removed.
Figure 26:
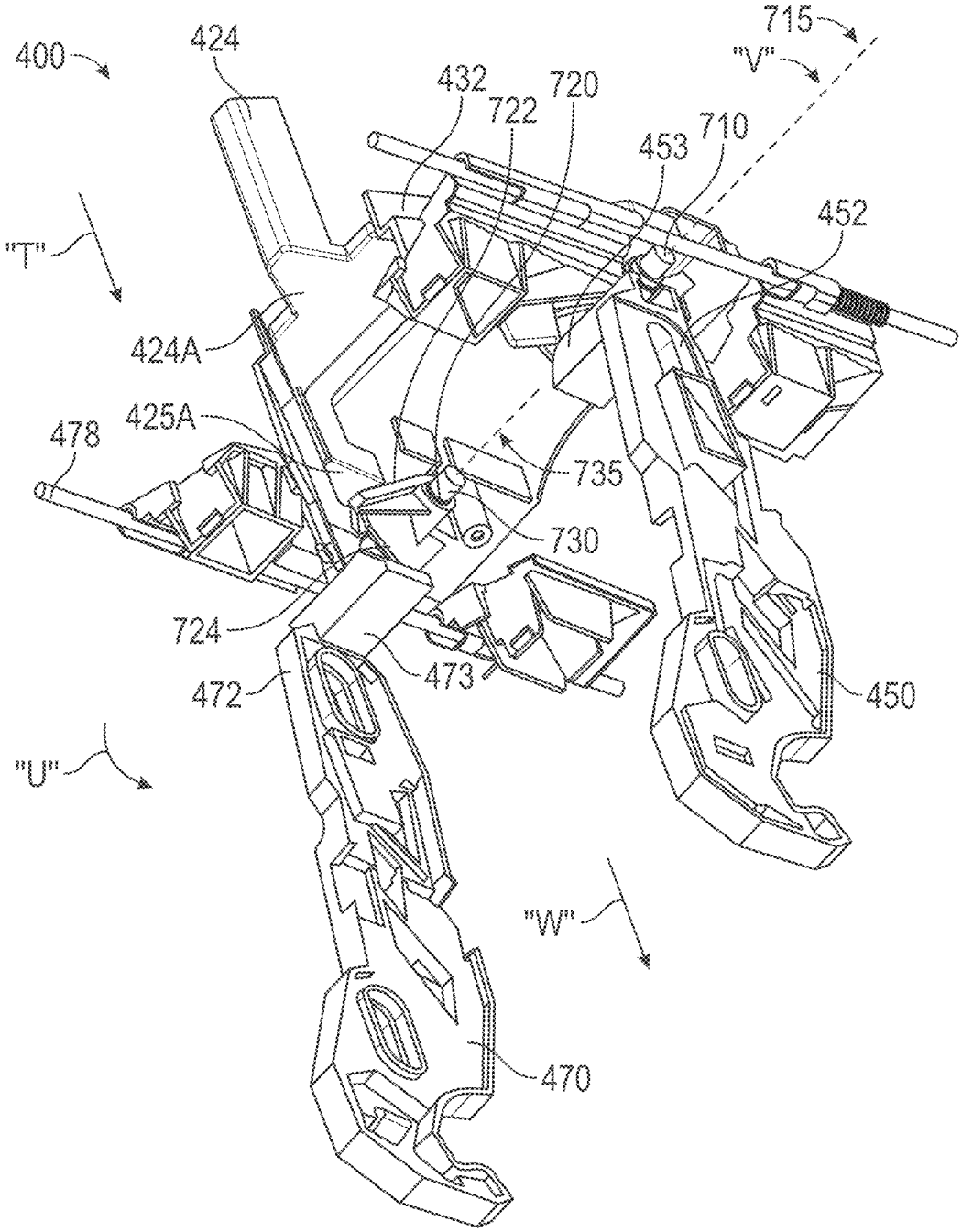
FIG. 26 illustrates a bottom perspective view of the components of the wing moving mechanism illustrated in FIG. 25.

Turning to FIGS. 25 and 26, several additional components of the removable transporter 400 have been removed to simplify the description of the remaining components. The removable transporter 400 has a housing 432 that is proximate to the vertically movable actuator 424. Plates or tabs 445 with collars 446 are mounted on rod 458 along with biasing member 459. Similarly, plates or tabs 465 with collars 466 are mounted on rod 478 along with biasing member 479. Each of the latch members 450 and 470 has an inwardly directed latch 456 and 476, respectively, that engages a catch on the body 402 of the removable transporter 400.

Figure 26B:
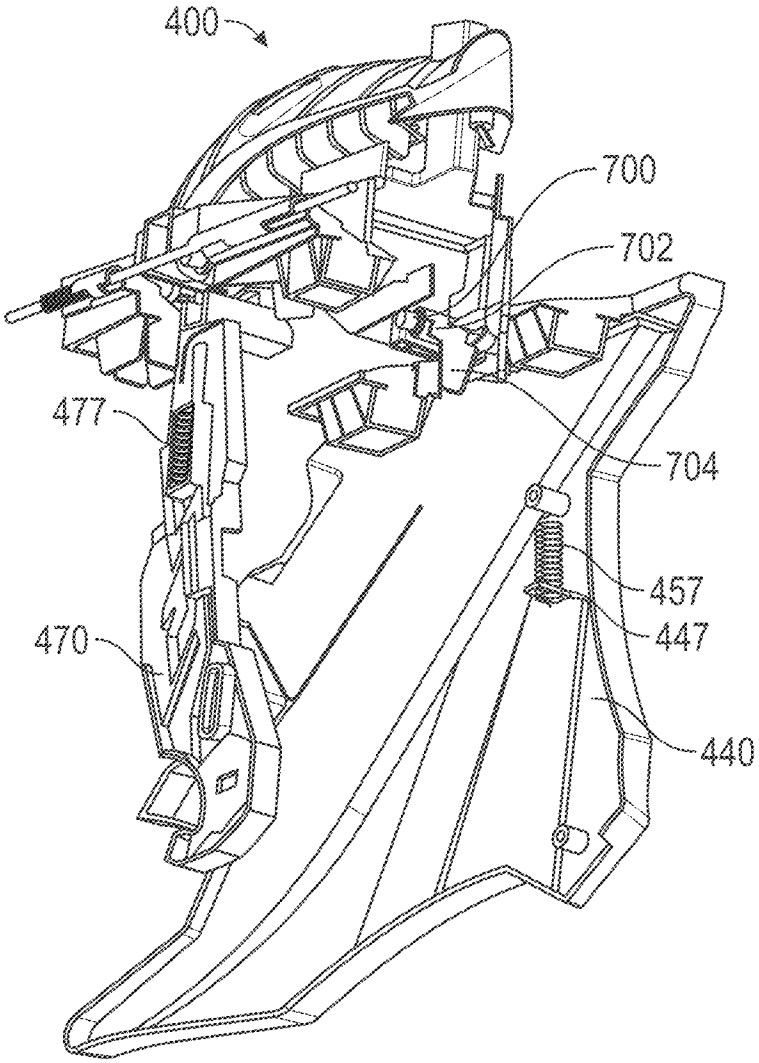
FIG. 26B illustrates another bottom perspective view of the components of the wing moving mechanism illustrated in FIG. 25.
Figure 26A:
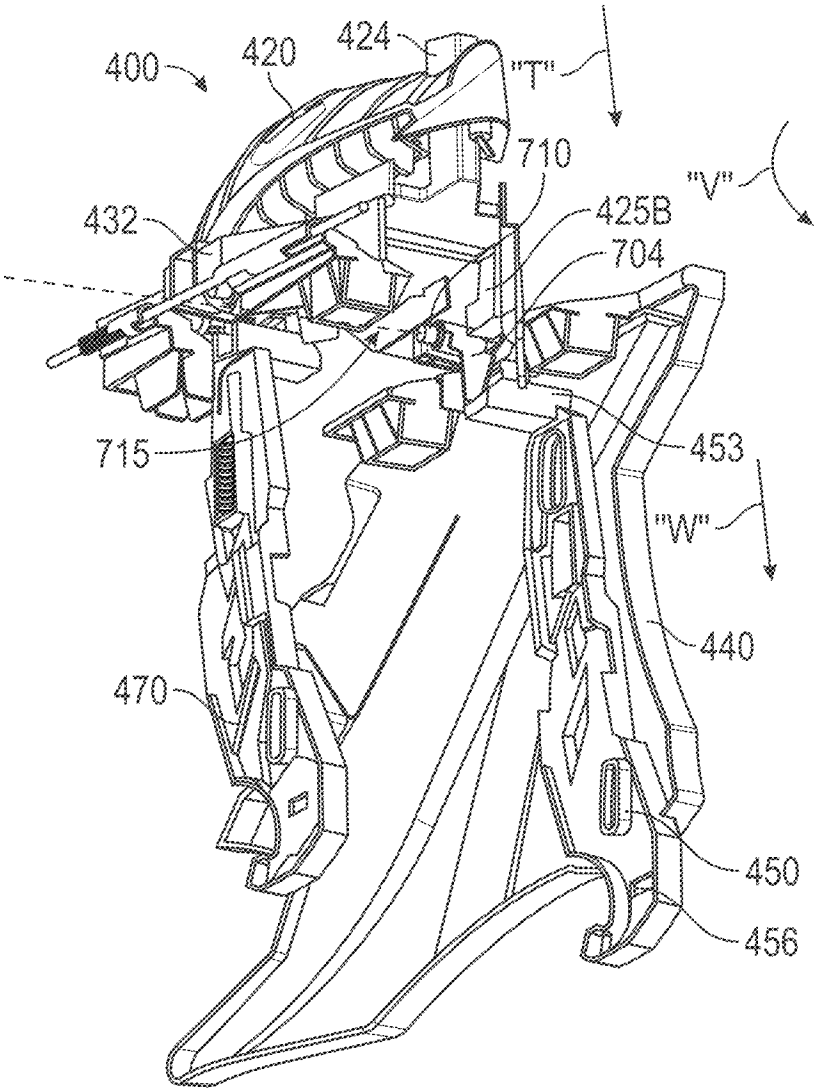
FIG. 26A illustrates another bottom perspective view of the components of the wing moving mechanism illustrated in FIG. 25.

The latch 476 on latch member 470 is shown in FIG. 25 and the latch 456 on latch member 450 is shown in FIG. 26A. The latch members 450 and 470 have upper ends 452 and 472, respectively. Each of the latch members 450 and 470 has a biasing member, such as a spring, that engages the particular latch member and its respective wing to bias the particular latch member upwardly. Latch member 450 has biasing member 457 (see FIG. 25) and latch member 470 has a biasing member 477 (see FIG. 26B).

Referring to FIGS. 26, 26A, and 26B, Latch member 450 has an upper end 452 with a tab 453 that is used to drive the latch member 450 downward. Similarly, latch member 470 has an upper end 472 with a tab 473 that is engaged to drive the latch member 479 downward. The actuator 424 extends upwardly from a body 424A that has two downwardly extending engaging portions, see engaging portion 425A in FIG. 26 and engaging portion 425B in FIG. 26A. The actuator 424 is slidable relative to housing 432.

Disposed below housing 432 is a pair of engaging members 700 and 720, which are located on opposite sides of housing 432. Referring to FIG. 26, engaging member 720 includes a body with an upper end 722 that is a horizontal plate from which a vertical plate extends downwardly forming a lower end 724. The body of the engaging member 720 is coupled to rod or axle 730 which defines an axis 735 about which the engaging member 720 can rotate. In one embodiment, the engaging member 720 is biased upwardly by a biasing member, and can be forced downwardly about axis 735 by a downward force applied to upper end 722. Referring to FIGS. 26, 26A and 26B, engaging member 700 includes a body with an upper end 702 that is a horizontal plate from which a vertical plate extends downwardly forming a lower end 704. The body of the engaging member 700 is coupled to rod or axle 710 which defines an axis 715 about which the engaging member 700 can rotate. In one embodiment, the engaging member 700 is biased upwardly by a biasing member, and can be forced downwardly about axis 715 by a downward force applied to upper end 702.

As mentioned above, latch member 450 is biased upwardly by its biasing member 457 and latch member 470 is biased upwardly by its biasing member 477. In FIG. 26B, a ledge 447 formed on wing 440 to which one end of the biasing member 457 is coupled is shown. In FIGS. 26, 26A, and 26B, the lower end 704 of engaging member 700 contacts the tab 453 of latch member 450. Similarly, the lower end 724 of engaging member 720 contacts the tab 473 of latch member 470. Referring to FIG. 26, when a user desires to open the wings 440 and 460 of the removable transporter 400 to their raised positions, the user pushes downwardly on actuator 424 along the direction of arrow "T". The actuator 424, body 424A, and engaging portions 425A and 425B move downwardly as well along arrow "T". Downward movement of engaging portions 425A and 425B force the upper ends 702 and 722 of engaging members 700 and 720, respectively, downward. That movement results in engaging member 700 pivoting along the direction of arrow "V" about axis 715 (see FIGS. 26 and 26A) and engaging member 720 pivoting along the direction of arrow "U" about axis 735 (FIG. 26).

When engaging member 700 pivots about axis 715, its lower end 704 engages tab 453 of latch member 450 and moves latch member 450 along the direction of arrow "W" against the upward force of biasing member 457. Movement of latch member 450 along arrow "W" results in the latch 456 disengaging from a catch on the body 402, thereby allowing wing 440 and latch member 450 to pivot along the direction of arrow "I" about axis 458A (see FIG. 24) to their raised positions. When a user wants to lower the wing 440, the user can manually move wing 440 and latch member 450 about axis 458A in the direction opposite to arrow "I" until the latch 456 re-engages with the catch on the body 402.

Similarly, when engaging member 720 pivots about axis 735, its lower end 724 engages tab 473 of latch member 470 and moves latch member 470 along the direction of arrow "W" against the upward force of biasing member 477. Movement of latch member 470 along arrow "W" results in the latch 476 disengaging from a catch on the body 402, thereby allowing wing 460 and latch member 470 to pivot along the direction of arrow "J" about axis 478A (see FIG. 24) to their raised positions. When a user wants to lower the wing 460, the user can manually move wing 460 and latch member 470 about axis 478A in the direction opposite to arrow "J" until the latch 476 re-engages with the catch on the body 402.

Figure 27:
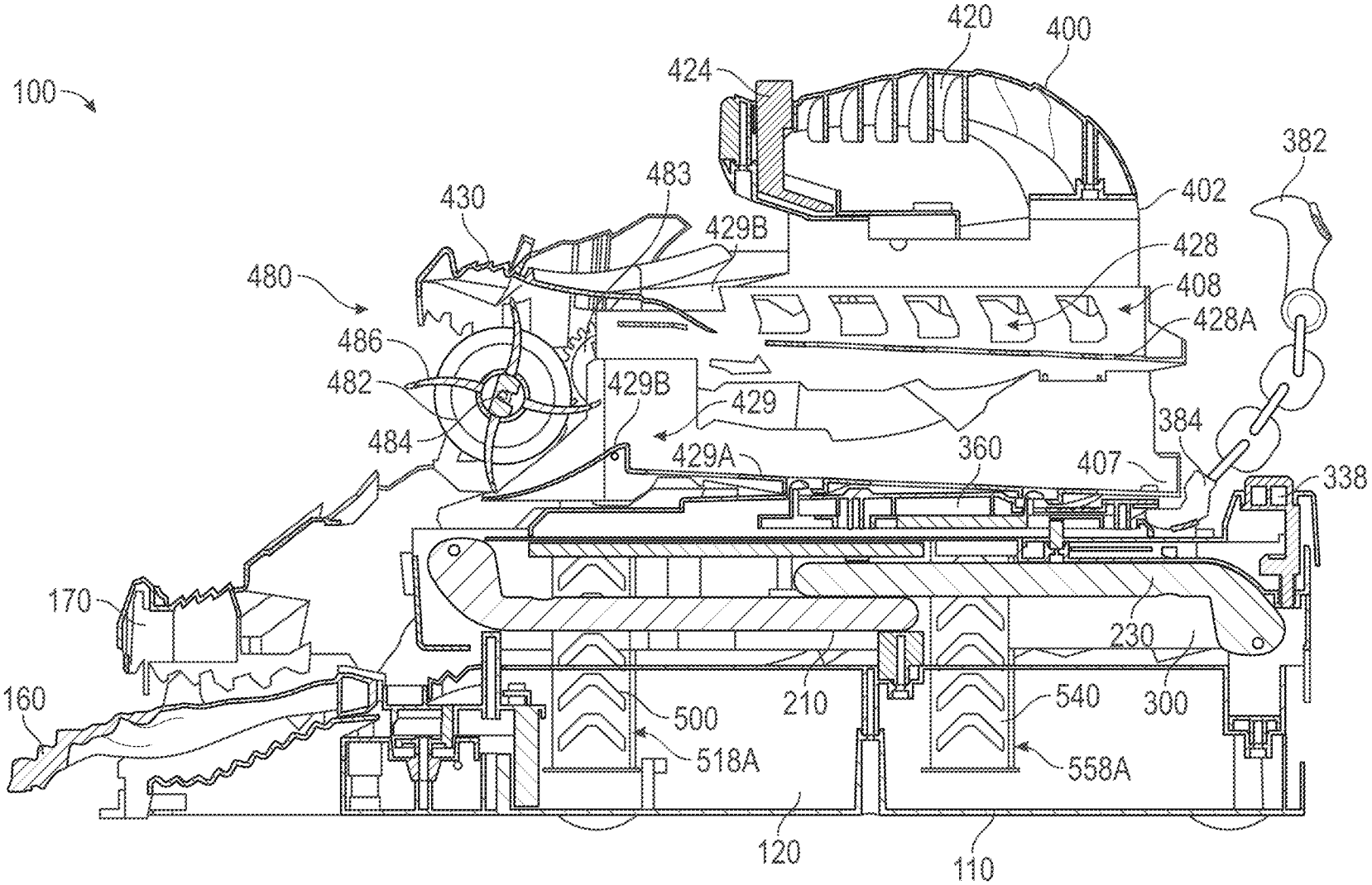
FIG. 27 illustrates a cross-sectional side view of the toy vehicle transporter illustrated in FIG. 2.

Referring to FIG. 27, a cross-sectional side view of the toy vehicle transporter 100 is illustrated. The transporter 110 with its pivotally mounted head member 170 and tongue 160 is illustrated. The arms 210 and 230 that pivotally couple the repositionable portion 300 to base portion 120 are shown. The details of the toy vehicle collector 480 of the removable transporter 400 are also shown. The hub 482 mounted on the axle 484 with its paddles 486 beneath pivotally mounted head 430. The gear 483 that drives the hub 482 for rotation (based off the rotation of the wheels of removable transporter 400) can be seen slightly to the rear of the hub 482. The various components of the body 402 of the removable transporter 400 are illustrated in FIG. 27. The handle 420 and the actuator 424 are coupled to the body 402. The body 402 includes a first internal cavity or receptacle 428 that is defined by wall 428A. Receptacle 428 is accessible via rear opening 408. A user can either insert toy vehicles into the receptacle 428 through the rear opening 408 and/or remove toy vehicles from the receptacle 428 via rear opening 408. As described above, toy vehicles can also travel into the receptacle 428 from the tracks in the wings 440 and 460. The body 402 also includes a second internal cavity or receptacle 429 that is located between wall 428A and a lower wall 429A. Receptacle 429 receives toy vehicles that have been moved into the body 402 via the toy vehicle collector 480 along surface 429B.

The removable transporter 400 is mounted to the coupling platform 360. A lower surface 407 that engages a lower end 384 of the hook member 382 is shown. The actuator 338 is located to the rear of the lower end 384 of the hook member 382, which enables a user to engage the actuator 338 while the removable transporter 400 is mounted to the coupling platform 360.

In the cross-sectional view of FIG. 27, two supports 500 and 540 are shown extending downwardly from coupling platform 360. Support 500 is in its lowered position 518A relative to coupling platform 360. Similarly, support 540 is in its lowered position 558A relative to coupling platform 360. The supports 500, 520, and 540 are described in detail relative to FIGS. 28-36.

Figure 28:
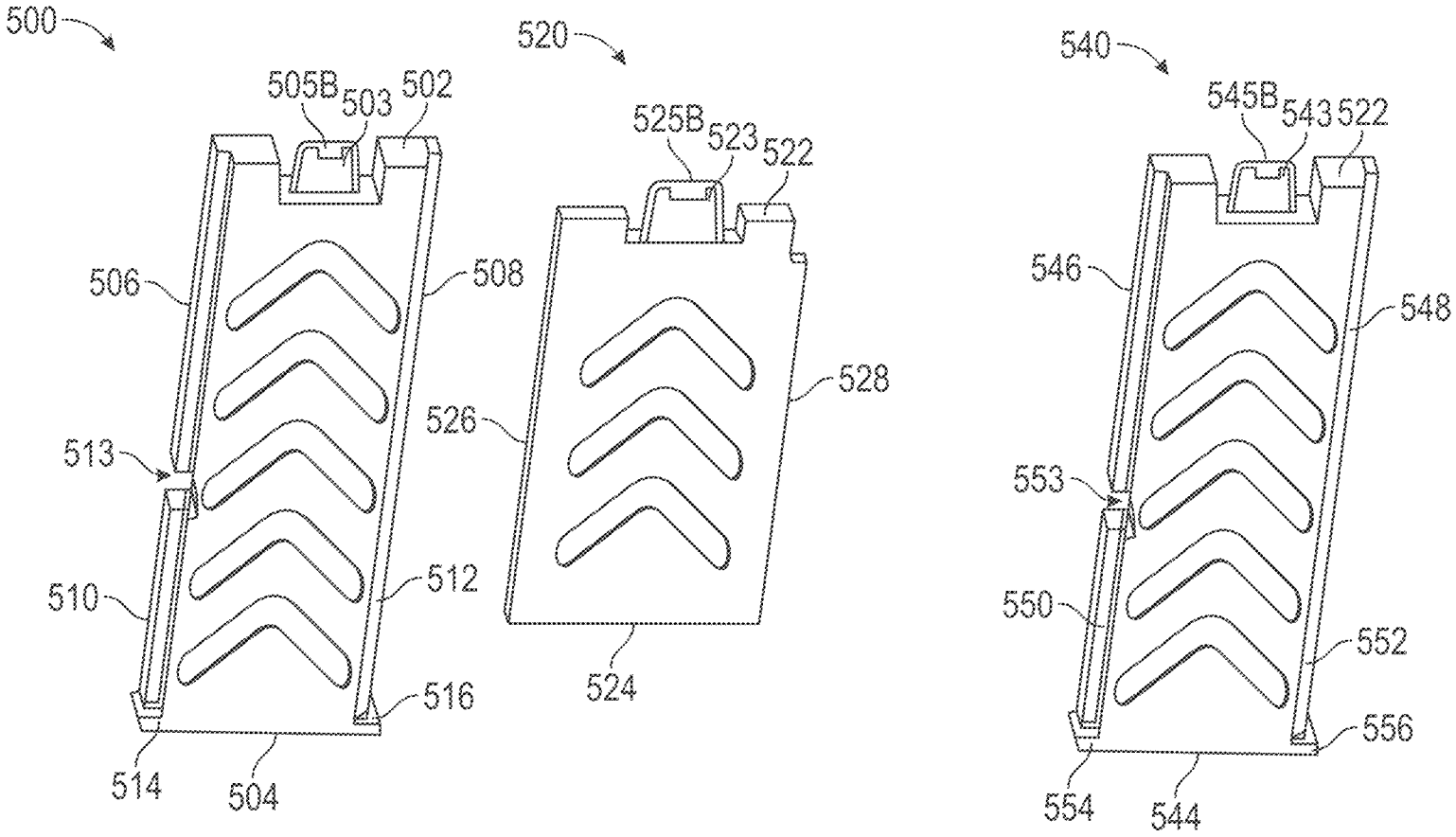
FIG. 28 illustrates perspective views of an embodiment of different supports of a toy vehicle transporter according to the present invention.
Figure 29:
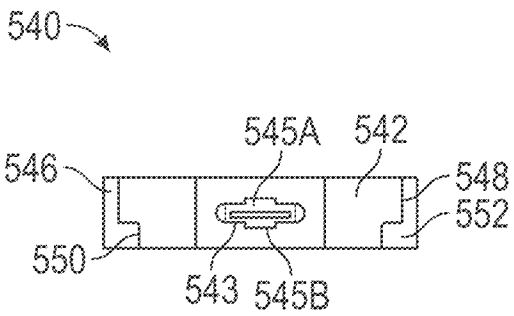
FIG. 29 illustrates top views of the supports illustrated in FIG. 28.
Figure 29:
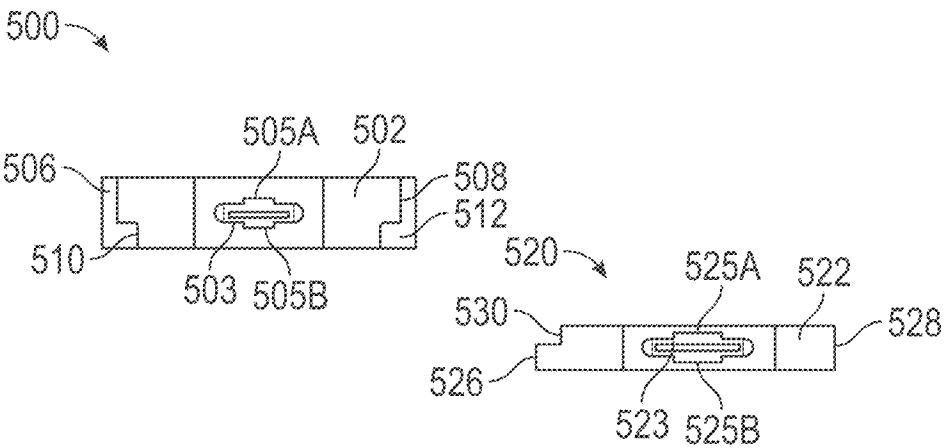

Referring initially to FIGS. 28 and 29, perspective views and top views, respectively, of supports 500, 520, and 540 are shown. Support 500 has an upper end 502 and a lower end 504 opposite the upper end 502. Extending between ends 502 and 504 are sides 506 and 508. Side 506 has a groove 510 extending therealong. Similarly, side 508 has a groove 512 extending therealong. In addition, side 506 has a notch 513 formed therein. At the bottom of support 500 are flanges 514 and 516 that extend outwardly in opposite directions from sides 506 and 508, respectively. Support 500 has a tab 503 extending upwardly from the upper end 502. In this embodiment, the tab 503 has outwardly extending projections 505A and 505B on opposite sides of the tab 503. The projections 505A and 505B are used to mount or couple the support 500 to the coupling platform 360.

Support 520 has an upper end 522 and a lower end 524 opposite the upper end 522. Extending between ends 522 and 524 are sides 526 and 528. In this embodiment, only side 526 has a groove 530 extending therealong. Extending upwardly from the upper end 522 of support 520 is a tab 523. Tab 523 has outwardly extending projections 525A and 525B on opposite sides of the tab 523. The projections 525A and 525B are used to mount or couple the support 520 to the coupling platform 360.

Support 540 has an upper end 542 and a lower end 544 opposite the upper end 542. Extending between ends 542 and 544 are sides 546 and 548. Side 546 has a groove 550 extending therealong. Similarly, side 548 has a groove 552 extending therealong. In addition, side 546 has a notch 553 formed therein. At the bottom of support 540 are flanges 554 and 556 that extend outwardly in opposite directions from sides 546 and 548, respectively. Support 540 has a tab 543 extending upwardly from the upper end 542. Tab 543 has outwardly extending projections 545A and 545B on opposite sides, which are used to mount or couple the support 540 to the coupling platform 360.

Figure 30:
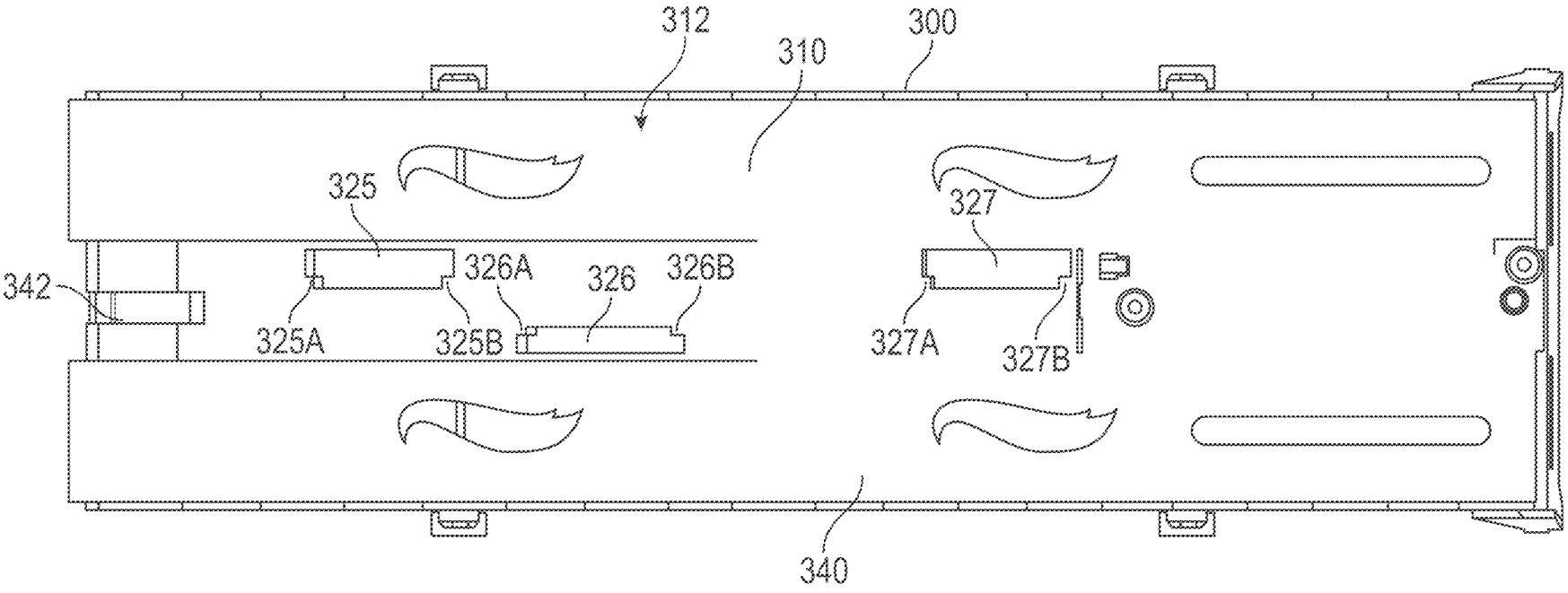
FIG. 30 illustrates a top view of the repositionable portion of the toy vehicle transporter.

The supports 500, 520, and 540 are coupled to the coupling platform 360 and are slidably mounted in the repositionable portion 300 and are. The supports 500, 520, and 540 are movable between their lowered positions and raised positions relative to the repositionable portion 300. Turning to FIG. 30, a top view of the repositionable portion 300 is illustrated. Repositionable portion 300 has a body 310 with an upper surface 312 and is formed of upper member 340 and lower member 342. In FIG. 30, the top view is of the upper member 340 and only a small portion of lower member 342 is shown. The body 310 (including both the upper member 340 and lower member 342) has three slots formed therethrough, each of which has one of the supports 500, 520, and 540 slidably mounted therein. Slot 325 is configured to slidably receive support 500 and has rails 325A and 325B that engage grooves 510 and 512, respectively. Slot 326 is configured to slidably receive support 520 and has rails 326A and 326B, with rail 326A engaging groove 530 of support 520. Slot 327 is configured to slidably receive support 540 and has rails 327A and 327B that engage grooves 550 and 552, respectively.

Figure 31:
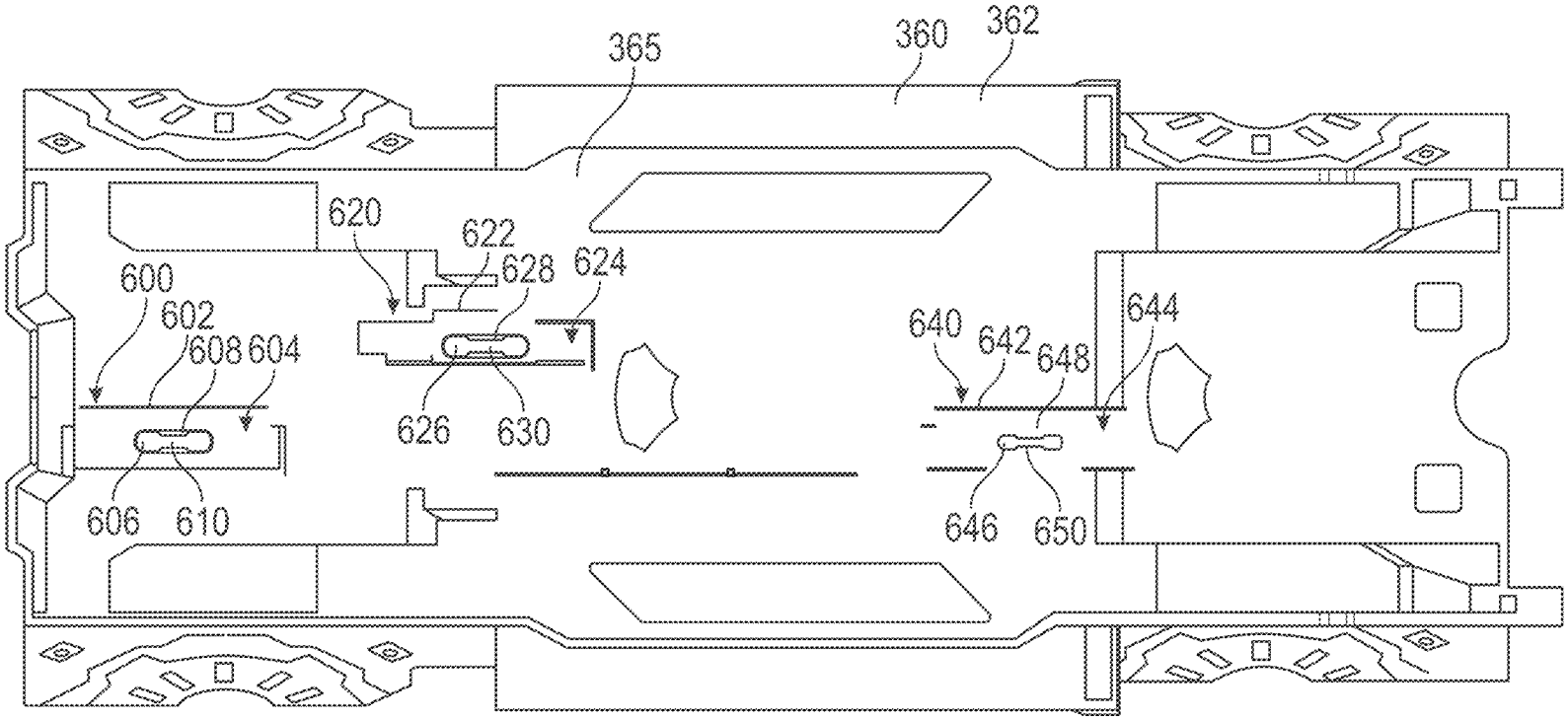
FIG. 31 illustrates a bottom view of the repositionable portion illustrated in FIG. 30.
Figure 32:
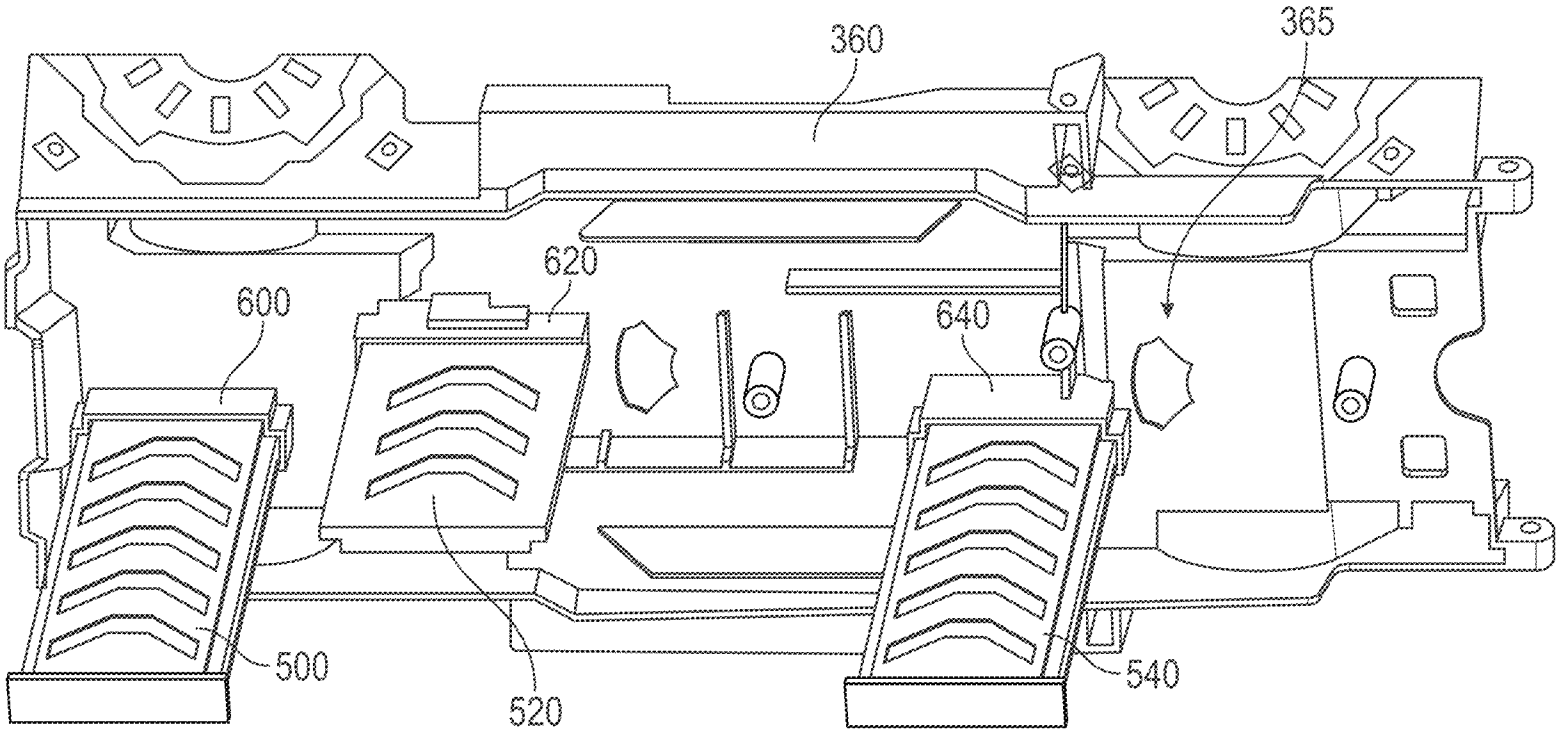
FIG. 32 illustrates a perspective view of the bottom of the repositionable portion illustrated in FIG. 30 with the supports coupled thereto.

Turning to FIGS. 31 and 32, bottom views of coupling platform 360 is illustrated. In FIG. 31, the bottom surface 365 of body 362 of the coupling platform 360 is shown. Extending from the bottom surface 365 are three mounting structures 600, 620, and 640 to which the supports 500, 520, and 540 are coupled, respectively, as shown in FIG. 32.

Referring to FIG. 31, in this embodiment, mounting structure 600 has a wall 602 that defines a receptacle 604. A slot 606 is defined in and is formed through the body 362 and is in communication with receptacle 604. A pair of projections 608 and 610 extend inwardly into the slot 606 from opposite sides of the slot 606. When the support 500 is inserted into the mounting structure 600, the support 500 can be coupled to the coupling platform 360. The upper end 502 of support 500 is inserted into receptacle 604 and tab 503 engages slot 606, which causes projections 505A and 505B to engage and pass over projections 608 and 610, respectively. The engagement of projections 505A and 505B and projections 608 and 610 keeps support 500 mounted to coupling platform 360. To separate support 500 from coupling platform 360, a user can pull on support 500 downwardly to cause projections 505A and 505B to pass over and disengage from projections 608 and 610.

Support 520 is similarly mounted to coupling platform 360. Mounting structure 620 has a wall 622 that defines a receptacle 624. A slot 626 is defined in and is formed through the body 362 and is in communication with receptacle 624. A pair of projections 628 and 630 extend inwardly into the slot 626 from opposite sides of the slot 626. When the support 520 is inserted into the mounting structure 620, the support 520 can be coupled to the coupling platform 360. The upper end 522 of support 520 is inserted into receptacle 624 and tab 523 engages slot 626, which causes projections 525A and 525B to engage and pass over projections 628 and 630, respectively. The engagement of projections 525A and 525B and projections 628 and 630 keeps support 520 mounted to coupling platform 360. To separate support 520 from coupling platform 360, a user can pull on support 520 downwardly to cause projections 525A and 525B to pass over and disengage from projections 628 and 630.

Support 540 is also similarly mounted to coupling platform 360. Mounting structure 640 has a wall 642 that defines a receptacle 644. A slot 646 is defined in and formed through the body 362 and is in communication with receptacle 644. A pair of projections 648 and 650 extend inwardly into the slot 646 from opposite sides of the slot 646. When the support 540 is inserted into the mounting structure 640, the support 540 can be coupled to the coupling platform 360. The upper end 542 of support 540 is inserted into receptacle 644 and tab 543 engages slot 646, which causes projections 545A and 545B to engage and pass over projections 648 and 650, respectively. The engagement of projections 545A and 545B and projections 648 and 650 keeps support 540 mounted to coupling platform 360. To separate support 540 from coupling platform 360, a user can pull on support 540 downwardly to cause projections 545A and 545B to pass over and disengage from projections 648 and 650.

Figure 33:
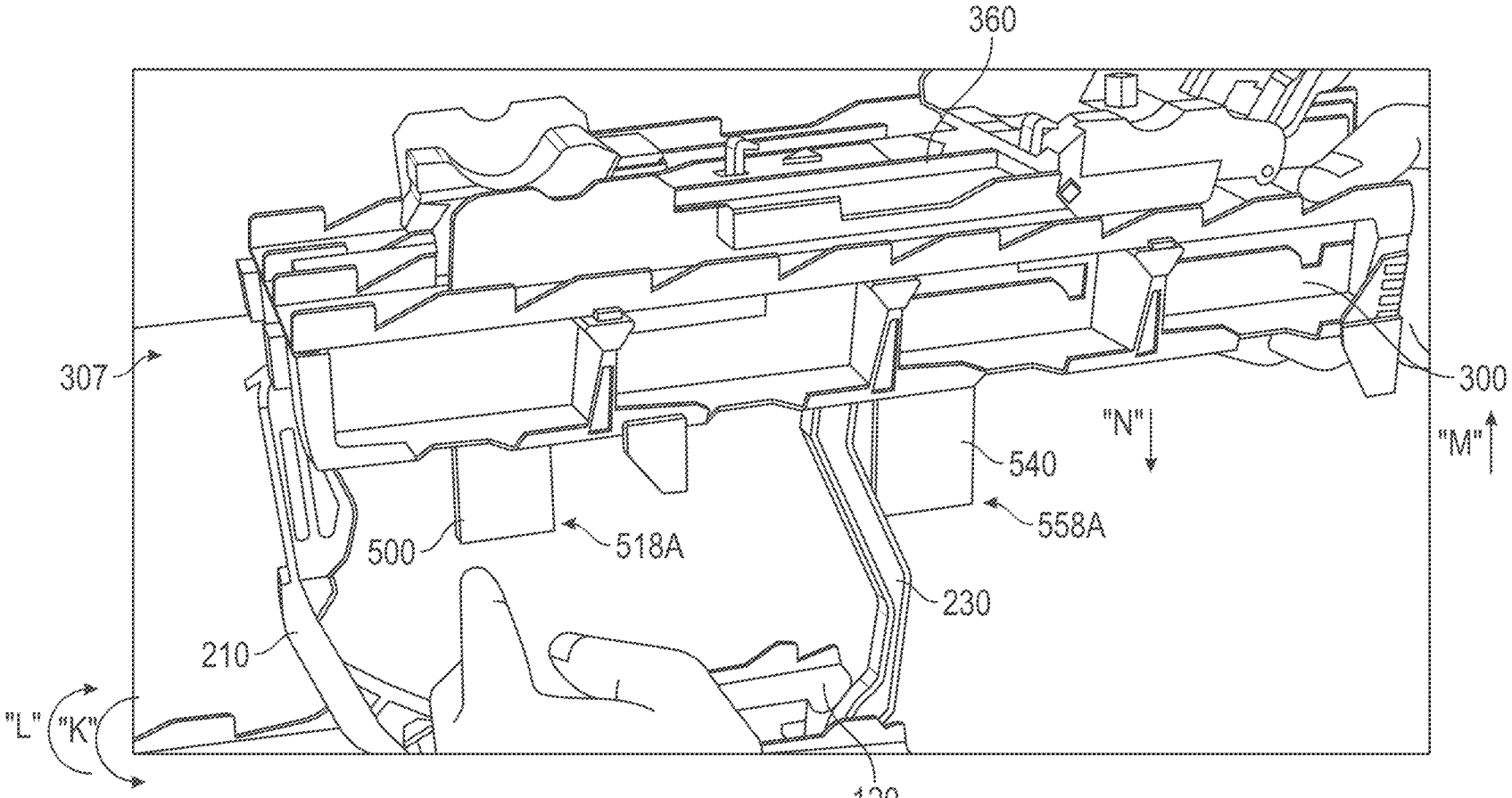
FIG. 33 illustrates a perspective view of the repositionable portion in an intermediate position relative to the base portion of the toy vehicle transporter.

Turning to FIGS. 33-36, perspective views showing the movement and positions of supports 500, 520, and 540 are illustrated. Initially referring to FIG. 33, a user has grasped repositionable portion 300 and moved it relative to base portion 120. Repositionable portion 300 is in an intermediate position 307 in FIG. 33. The user can move repositionable portion 300 along the direction of arrow "K" to locate the repositionable portion 300 in its folded position 306 on top of the base portion 120. Alternatively, the user can move the repositionable portion 300 along the direction of arrow "L" to locate the repositionable portion 300 in its deployed or unfolded position 308 in an end-to-end arrangement with base portion 120. Movement of the repositionable portion 300 relative to the base portion 120 is accomplished via coupling arms 210 and 230, which, as described above, are coupled to portions 120 and 300. In FIG. 33, it is noteworthy that the removable transporter 400 has been decoupled and removed from the coupling platform 360. When the coupling platform 360 (by way of the removable transporter 400) is not used to move the repositionable portion 300 relative to the base portion 120, the supports 500, 520, and 540 extend downwardly from the repositionable portion 300. In other works, when repositionable portion 300 is moved along the direction of arrow "M", the supports 500, 520, and 540 move along the direction of arrow "N" to their lowered positions. In FIG. 33, only supports 500 and 540 are illustrated in their respective lowered positions 518A and 558A.

Figure 34:
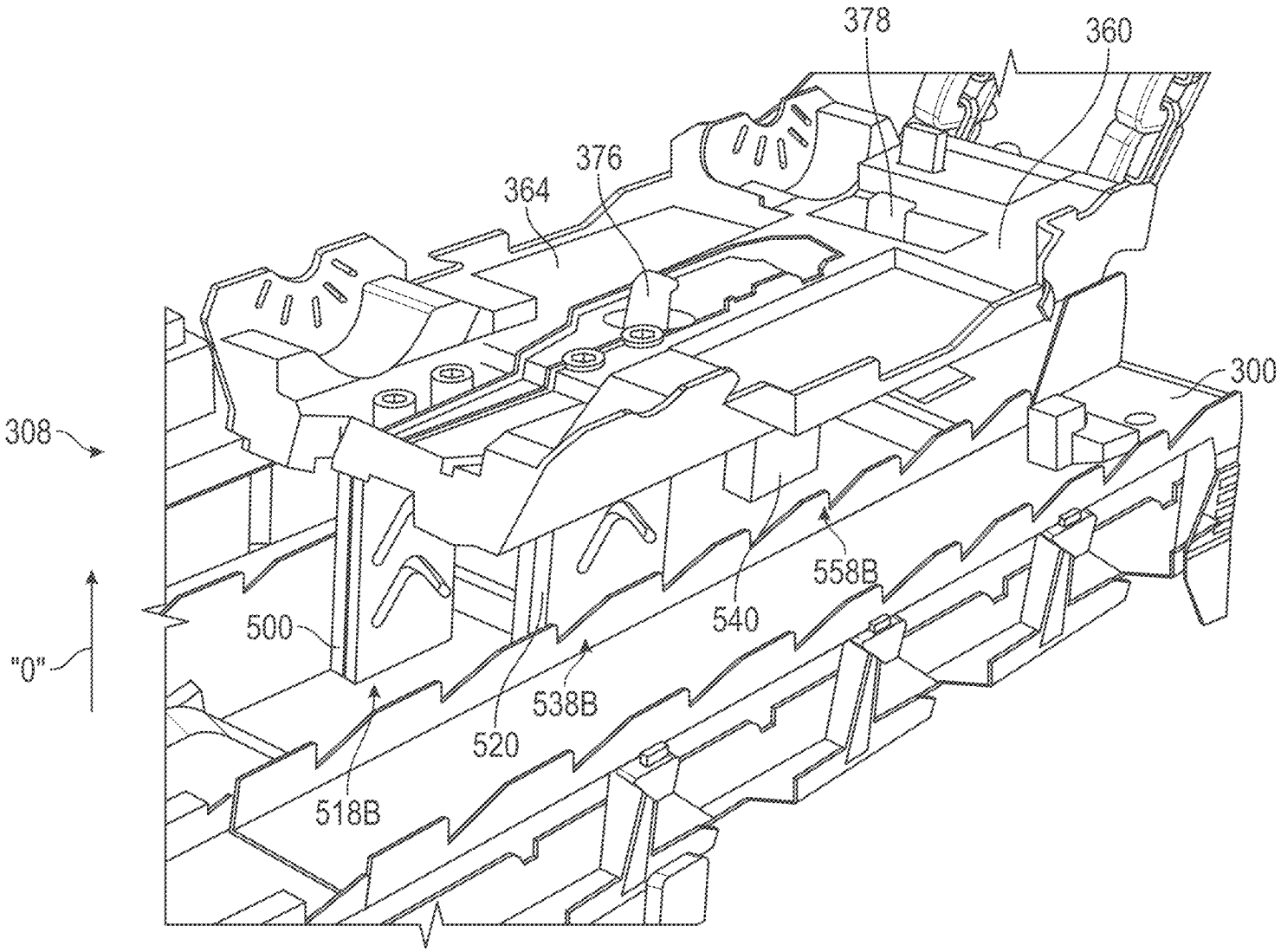
FIG. 34 illustrates a perspective view of the repositionable portion in its deployed position without the removable transporter coupled thereto.
Figure 35:
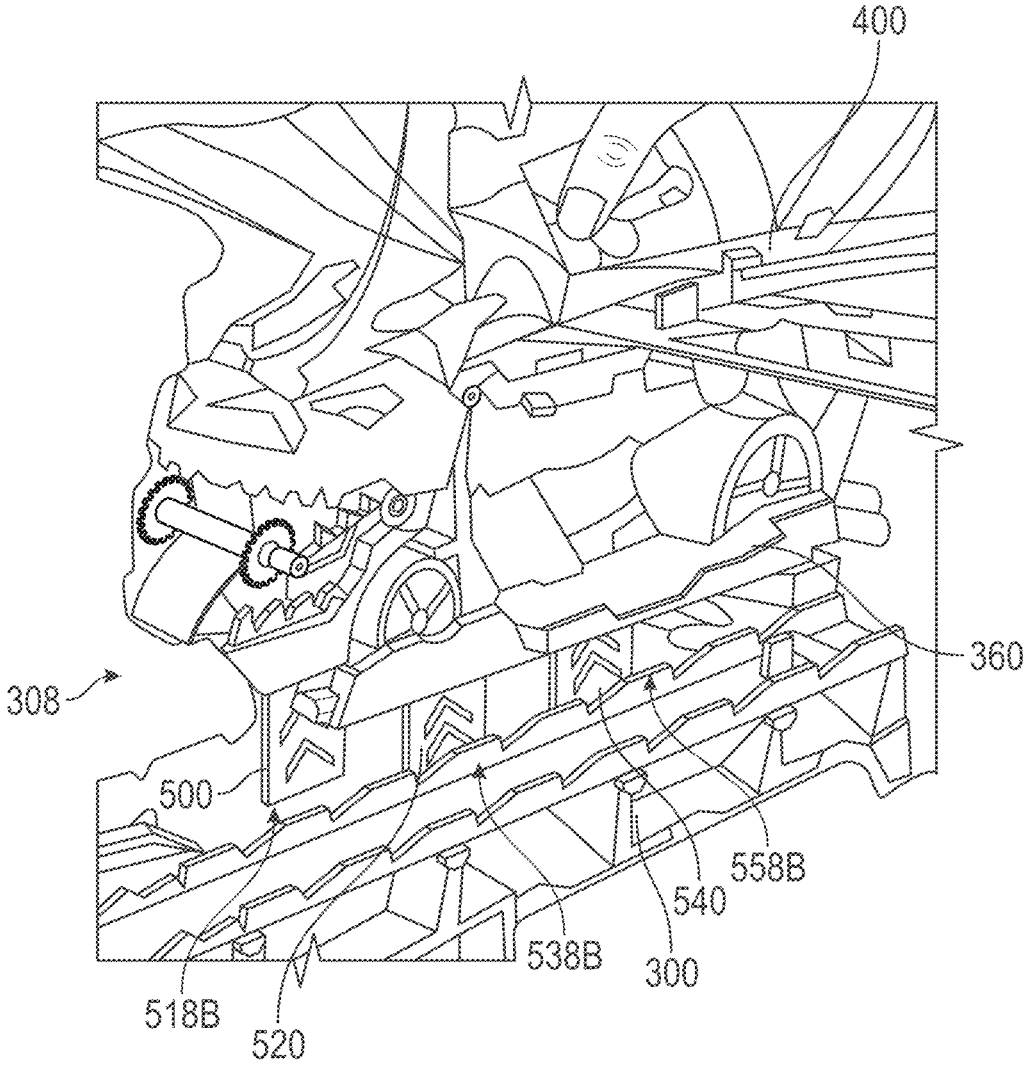
FIG. 35 illustrates a perspective view of the repositionable portion in its deployed position with the removable transporter coupled thereto.

Referring to FIGS. 34 and 35, the coupling platform 360 and repositionable portion 300 are shown in their deployed position 308. In this position 308, repositionable portion 300 engages a support surface. The lower ends 504, 524, and 544 of the downwardly extending supports 500, 520, and 540, which are mounted to the coupling platform 360, engage the support surface and force the supports 500, 520, and 540 along the direction of arrow "O" to their raised positions 518B, 538B, and 558B, respectively. A few features of the coupling platform 360 are also shown in FIG. 34. In particular, the upper surface 364 of coupling platform 360 has latches 376 and 378 extending therethrough. In FIG. 35, the removable transporter 400 is coupled to the latches 376 and 378 of the coupling platform 360.

Figure 36:
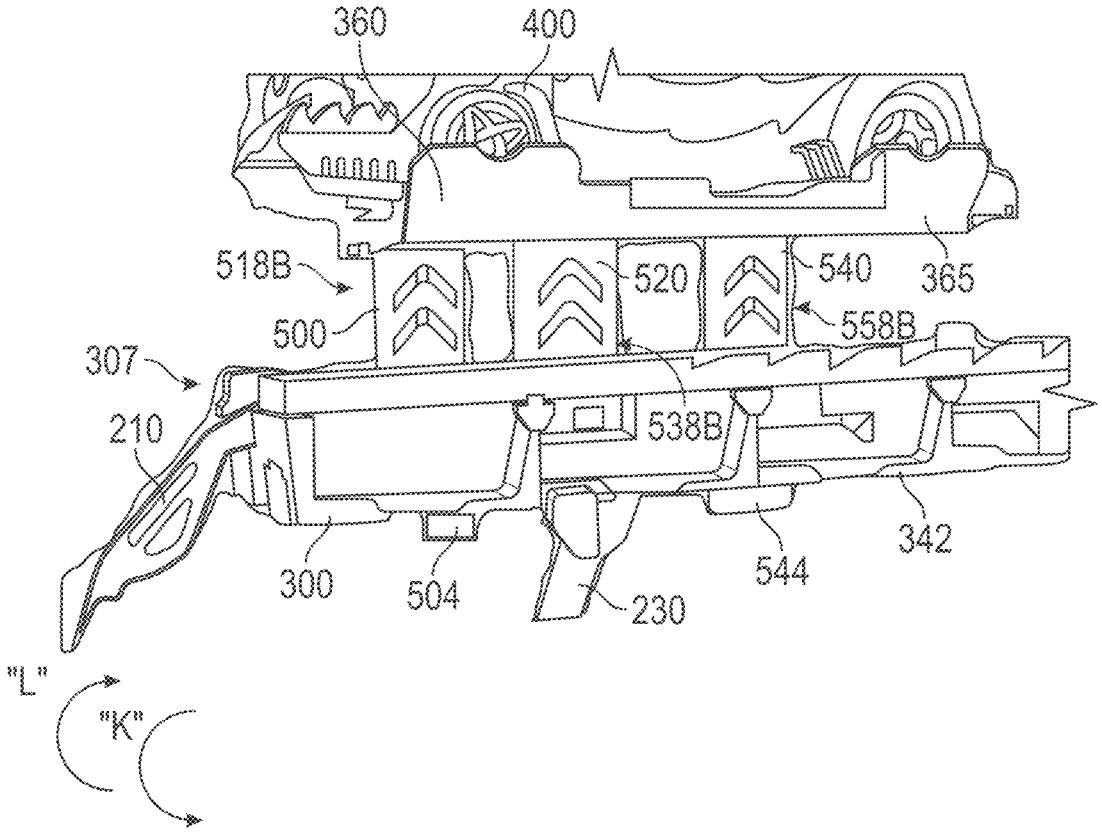
FIG. 36 illustrates a perspective view of the repositionable portion in an intermediate position with the removable transporter coupled thereto.

Turning to FIG. 36, the repositionable portion 300, shown in its intermediate position 307, can be moved by a user along the directions of arrow "K" or arrow "L". While parts of coupling arms 210 and 230 are shown, the base portion 120 is not shown. When a user grasps the handle of the removable transporter 400 and lifts upwardly to move the repositionable portion 300 along the direction of arrow "K", the coupling platform 360 is also lifted upwardly because it is coupled to the removable transporter 400. The supports 500, 520, and 540, which are mounted to the lower surface 365 of coupling platform 360, are also moved to their raised positions 518B, 538B, and 558B, respectively, in which they extend upwardly above the top of the repositionable portion 300. In these positions, the lower ends 504 and 544 of supports 500 and 540 extend downwardly below the lower surface of the lower member 342. The flanges 514 and 516 on support 500 and the flanges 554 and 556 on support 540 limit the upward movement of the supports 500 and 540 (and as a result, the upward movement of coupling platform 360 as well) relative to the repositionable member 300.

By having the supports 500, 520, and 540 slidably mounted relative to the repositionable member 300, the risk of a pinch point for a user's fingers between the arms 210 and 230 and the portions 120 and 300 when a user is moving the repositionable portion 300 and removable transporter 400 back to the folded position 306 on top of the base portion 120 is mitigated. This mitigation is due to the supports 500, 520, and 540 being movably mounted and not fixed in place.

While the toy vehicle body presented herein is illustrated and described in detail and with reference to specific embodiments thereof, it is nevertheless not intended to be limited to the details shown, since it will be apparent that various modifications and structural changes may be made therein without departing from the scope of the disclosure and within the scope and range of equivalents of the claims. In addition, various features from one of the embodiments may be incorporated into another of the embodiments. That is, it is believed that the disclosure set forth above encompasses multiple distinct embodiments with independent utility. While each of these embodiments has been disclosed in a preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

Additionally, it is to be understood that terms such as "first," "second," "left," "right," "top," "bottom," "front," "rear," "side," "height," "length," "width," "upper," "lower," "interior," "exterior," "inner," "outer" and the like as may be used herein, merely describe points of reference and do not limit the present disclosure to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure.

Moreover, when used herein, the term "comprises" and its derivations (such as "comprising," "includes," "including," etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially". For example, the term "approximately" can denote a tolerance of plus or minus 0.002 inches, 0.001 inches, or up to 0.005 inches, or similarly, the term may denote a tolerance of approximately +/−1.0%. The same applies to the terms "about" and "around" and "substantially." Moreover, for the purposes of the present disclosure, the phrase "A and/or B" means (A), (B), or (A and B), and the phrase "A, B, and/or C" means (A), (B), (C), (A and B), (A and C), (B and C), or (A, B and C).

What is claimed is:

1. A reconfigurable toy vehicle transporter, comprising:

a toy vehicle transporter that is reconfigurable between a first configuration and a second configuration, the toy vehicle transporter including:

a base portion including a first surface having a first track, the base portion including a first compartment in which a toy vehicle can be stored; and a repositionable portion movably coupled to the base portion, the repositionable portion having a second compartment in which a toy vehicle can be stored, the repositionable portion including a second surface having a second track, the repositionable portion being placeable in a first position located above the first surface of the base portion and in a second position in an end-to-end arrangement with the base portion in which the first track and the second track are aligned and continuous; and a removable transporter that is separable from and removably coupleable to the toy vehicle transporter, wherein the removable transporter has a third compartment in which a toy vehicle can be stored.

2. The reconfigurable toy vehicle transporter of claim 1, wherein the toy vehicle transporter includes a first arm and a second arm, each of the first arm and the second arm is pivotally coupled to the base portion and also pivotally coupled to the repositionable portion, and the repositionable portion is moved relative to the base portion via movement of the first arm and the second arm.

3. The reconfigurable toy vehicle transporter of claim 2, wherein the first arm is coupled to the base portion at a first location and coupled to the repositionable portion at a second location, the second arm is coupled to the base portion at a third location and coupled to the repositionable portion at a fourth location, the first location being forward of the third location, and the second location being forward of the fourth location.

4. The reconfigurable toy vehicle transporter of claim 2, wherein the base portion has a first slot and the repositionable portion has a second slot, and the first arm and the second arm are located in the first slot and the second slot when the repositionable portion is in its first position above the base portion.

5. The reconfigurable toy vehicle transporter of claim 1, wherein the base portion has an outlet opening that is in communication with the first track, the repositionable portion has a launcher proximate to the second track, and when the repositionable portion is in its second position, the launcher can be actuated to launch a toy vehicle along the second track, then along the first track, and then through the outlet opening.

6. The reconfigurable toy vehicle transporter of claim 1, wherein the removable transporter includes a body having an inlet through which toy vehicles can be collected from a support surface.

7. The reconfigurable toy vehicle transporter of claim 1, wherein the removable transporter includes a body having a first side and a second side opposite the first side, the body includes a first wing pivotally mounted to the first side, a second wing pivotally mounted to the second side, and an input member that can be actuated to cause the first wing and the second wing to pivot relative to the body of the removable transporter.

8. The reconfigurable toy vehicle transporter of claim 7, wherein the body includes an internal receptacle, the first wing includes a first track portion that is oriented toward the internal receptacle, and a toy vehicle can be placed on the first track portion of the first wing and can travel from the first wing to the internal receptacle.

9. The reconfigurable toy vehicle transporter of claim 1, wherein the repositionable portion includes a holding member pivotally connected to the repositionable portion, and the holding member engages the removable transporter when the removable transporter is placed on the toy vehicle transporter.

10. The reconfigurable toy vehicle transporter of claim 1, wherein the toy vehicle transporter has a locking member, and the removable transporter has a release mechanism that can be actuated to decouple the removable transporter from the toy vehicle transporter.

11. A reconfigurable toy vehicle transporter, comprising:

a toy vehicle transporter that is reconfigurable between a first configuration and a second configuration, the toy vehicle transporter including:

a base including a first compartment in which a toy vehicle can be stored; and a repositionable portion movably coupled to the base, the repositionable portion having a second compartment in which a toy vehicle can be stored, the repositionable portion being placeable in a first position above the base and in a second position in an end-to-end arrangement with the base; and a removable transporter that is separable from and removably coupleable to the toy vehicle transporter, wherein the removable transporter has a third compartment in which a toy vehicle can be stored and the removable transporter has a toy vehicle intake mechanism that can collect toy vehicles from a support surface.

12. The reconfigurable toy vehicle transporter of claim 11, wherein the toy vehicle transporter includes an arm that is pivotally coupled to the base and pivotally coupled to the repositionable portion, and the repositionable portion is moved relative to the base via the arm.

13. The reconfigurable toy vehicle transporter of claim 12, wherein the removable transporter includes a body having a wing pivotally mounted thereto, an actuator that can be engaged by a user to move the wing relative to the body of the removable transporter, and an internal receptacle that receives a toy vehicle that travels along the wing into the internal receptacle.

14. The reconfigurable toy vehicle transporter of claim 11, wherein the base has a first track, the repositionable portion has a second track, and the second track is aligned with the first track when the repositionable portion is in its second position.

15. The reconfigurable toy vehicle transporter of claim 14, wherein the base has an outlet opening that is in communication with the first track, the repositionable portion has a launcher proximate to the second track, and when the repositionable portion is in its second position, the launcher can be actuated to launch a toy vehicle along the second track, then along the first track, and then through the outlet opening.

16. A reconfigurable toy vehicle transporter, comprising:

a toy vehicle transporter including:

a base having an upper surface with a track formed therein, the base including a first compartment in which a toy vehicle can be stored; and a repositionable portion movably coupled to the base, the repositionable portion having a second compartment in which a toy vehicle can be stored, the repositionable portion having its own upper surface with a track formed therein, the repositionable portion being placeable in a first position above the base and in a second position end-to-end with the base in which the tracks are aligned and continuous, the repositionable portion including a launcher that can be actuated to propel a toy vehicle along the track on the repositionable portion and then along the track on the base; and a removable transporter that is separable from and removably coupleable to the toy vehicle transporter, wherein the removable transporter has a third compartment in which a toy vehicle can be stored.

17. The reconfigurable toy vehicle transporter of claim 16, wherein the removable transporter includes a body has a first internal receptacle in which collected toy vehicles are disposed.

18. The reconfigurable toy vehicle transporter of claim 17, wherein the body has a wing pivotally mounted to the body, and an actuator that can be engaged to cause the wing to pivot relative to the body, the wing including a track portion that is directed toward a second internal receptacle in the body so that a toy vehicle placed on the track portion travels from the wing to the second internal receptacle.

19. The reconfigurable toy vehicle transporter of claim 16, wherein the repositionable portion includes a holding member pivotally connected to the repositionable portion, and the holding member engages the removable transporter when the removable transporter is placed on the toy vehicle transporter.

20. The reconfigurable toy vehicle transporter of claim 16, wherein the toy vehicle transporter has a locking member, the removable transporter includes a release mechanism that can be actuated to decouple the removable transporter from the toy vehicle transporter.

* * * * *